US009562404B2

(12) United States Patent
Klotz et al.

(10) Patent No.: US 9,562,404 B2
(45) Date of Patent: Feb. 7, 2017

(54) WELL TUBING HANGER ADAPTED FOR USE WITH POWER TONGS AND METHOD OF USING SAME

(71) Applicant: TITUS TOOLS, INC., Lloydminster (CA)

(72) Inventors: Tracy Earl Klotz, Lloydminster (CA); Colin James Nielsen Daigle, Marwayne (CA)

(73) Assignee: Titus Tools, Inc., Llyodminster, Alberta (CA)

( * ) Notice: Subject to any disclaimer, the term of this patent is extended or adjusted under 35 U.S.C. 154(b) by 359 days.

(21) Appl. No.: 14/202,914

(22) Filed: Mar. 10, 2014

(65) Prior Publication Data

US 2015/0041152 A1 Feb. 12, 2015

Related U.S. Application Data

(63) Continuation of application No. 13/132,490, filed as application No. PCT/CA2009/001759 on Dec. 4, 2009, now abandoned.

(30) Foreign Application Priority Data

Dec. 5, 2008 (CA) ..... 2646231

(51) Int. Cl.
*E21B 19/06* (2006.01)
*E21B 31/00* (2006.01)
(Continued)

(52) U.S. Cl.
CPC ..... *E21B 19/06* (2013.01); *E21B 17/042* (2013.01); *E21B 19/16* (2013.01); *E21B 31/005* (2013.01); *E21B 33/04* (2013.01)

(58) Field of Classification Search
CPC ..... E21B 33/04; E21B 31/005; E21B 19/06; E21B 19/16; E21B 17/042
See application file for complete search history.

(56) References Cited

U.S. PATENT DOCUMENTS 1,389,920 A 9/1921 Weaver et al.
1,793,780 A 2/1931 Daniel
(Continued)

FOREIGN PATENT DOCUMENTS

CA 2215755 8/1998
CA 2393933 A1 7/2001
(Continued)

OTHER PUBLICATIONS

Schlumberger Oilfield Glossary entries for "box", "pin", and "threadform", accessed Apr. 26, 2016 via www.glossary.oilfield.slb.com.*

(Continued)

*Primary Examiner* — Blake Michener
(74) *Attorney, Agent, or Firm* — BudzynFortunato IP Law, LLC

(57) ABSTRACT

A well tool adapted to be connected with and disconnected from a well tubing using a power tong device having a pair of tongs, a gripping span between the pair of tongs, and a maximum clearance diameter for an object passing through the tongs. The well tool includes a tubular mandrel. The tubular mandrel has a maximum mandrel diameter which is no greater than the maximum clearance diameter. The tubular mandrel includes a first mandrel connector which is adapted for connecting the tubular mandrel with a first well tubing in order to provide a first connection. The tubular mandrel is configured so that when the power tong device grips a tong gripping surface on the tubular mandrel and the first well tubing in order to connect the tubular mandrel and (Continued)

the first well tubing, the first connection is located within the gripping span.

71 Claims, 9 Drawing Sheets

(51) Int. Cl.
*E21B 33/04* (2006.01)
*E21B 17/042* (2006.01)
*E21B 19/16* (2006.01)

(56) References Cited

U.S. PATENT DOCUMENTS 1,909,304 A 5/1933 Mueller
1,931,024 A 10/1933 Howard
2,003,446 A 6/1935 Imler et al.
2,046,579 A * 7/1936 Penick ..... E21B 33/04 277/637
RE20,529 E * 10/1937 Penick et al. ..... E21B 33/04 166/75.14
2,148,327 A 2/1939 Smith et al.
2,148,360 A 2/1939 Lemley
2,150,887 A 3/1939 Mueller et al.
2,157,964 A 5/1939 Mueller
2,178,845 A 11/1939 Baker
2,241,333 A 5/1941 Smith
2,274,477 A 2/1942 Howard et al.
2,277,380 A 3/1942 Yancey
2,600,257 A 6/1952 Neilon
2,660,248 A * 11/1953 Brown ..... E21B 33/0415 166/78.1
2,676,036 A * 4/1954 Arrowood ..... E21B 33/0422 248/49
3,001,803 A 9/1961 Watts et al.
3,067,593 A 12/1962 McCool
3,155,401 A * 11/1964 Musolf ..... E21B 33/04 166/344
3,193,016 A 7/1965 Knox
3,552,412 A 1/1971 Hagar et al.
3,981,360 A 9/1976 Marathe
4,084,453 A 4/1978 Eckel
4,245,709 A 1/1981 Manuel
4,286,662 A 9/1981 Page, Jr.
4,315,542 A 2/1982 Dockins, Jr.
4,330,039 A 5/1982 Vann et al.
4,415,186 A 11/1983 Maestrami
4,549,613 A 10/1985 Case
4,631,987 A 12/1986 Buck
4,637,471 A 1/1987 Soderberg
4,645,007 A 2/1987 Soderberg
4,690,221 A 9/1987 Ritter, Jr.
4,718,495 A 1/1988 Lubitz et al.
4,834,176 A 5/1989 Renfroe, Jr.
4,944,349 A 7/1990 Von Gonten, Jr.
5,133,576 A 7/1992 Barnhill
5,275,441 A 1/1994 Claycomb
5,341,885 A * 8/1994 Bridges ..... E21B 33/043 166/208
5,465,788 A 11/1995 Wright
5,782,303 A 7/1998 Christian
6,019,175 A 2/2000 Haynes
6,082,224 A 7/2000 McDaniels et al.
6,591,915 B2 7/2003 Burris et al.
6,752,212 B2 6/2004 Burris et al.
7,000,503 B2 2/2006 Dagenais et al.
7,121,166 B2 10/2006 Drzewiecki
7,159,652 B2 1/2007 McGuire et al.
7,413,398 B2 8/2008 Bangert et al.
7,661,474 B2 2/2010 Campbell et al.
7,762,333 B2 7/2010 Themig et al.
2003/0140736 A1 7/2003 Buck
2004/0129429 A1* 7/2004 Dallas ..... E21B 33/12 166/377
2004/0195555 A1 10/2004 Bangert et al.
2004/0216867 A1 11/2004 Burris et al.
2007/0034381 A1 2/2007 Campbell et al.
2007/0210577 A1 9/2007 Pollack et al.
2011/0232895 A1* 9/2011 Klotz ..... E21B 33/04 166/77.51

FOREIGN PATENT DOCUMENTS

CA 2637519 A1 10/2009
CA 2646231 A1 6/2010
CA 2743294 A1 6/2010
CA 2778244 A1 6/2010
CN 89104971 A 2/1990
WO 2005001234 A1 1/2005

OTHER PUBLICATIONS

TechWest Inc. Product Catalogue; Aug. 1, 2002. (Tab 21).
Excerpt from TechWest Inc. Product Catalogue, "Downhole Swivel" Product Information, Aug. 1, 2002. (Tab 22).
Plainsman Type SB Tubing Drain Specifications Sheet; Oct. 23, 2006. (Tab 11).
Plainsman Type SB Tubing Drain Technical Data Sheet; Apr. 1, 2008. (Tab 15).
Plainsman Type SB Tubing Drain Brochure; Feb. 26, 2009. (Tab 16).
Houston Engineers Inc., 6-80 Operation Manual for HYDRA JAR®, dated May 1998.
TechWest Inc. Brochure (undated).
Plainsman Mfg. Inc. SB Tubing Drain (undated).
Plainsman Mfg. Inc. Type SB Tubing Drain (Oct. 23, 2006).
Technical Data Sheet, Plainsman Mfg. Inc., Type SB Tubing Drain.
3 Draftsman Drawings of 4 1/2 and 5 1/2 Tubing Drain Body by Plainsman Mfg. Inc. (Marked as confidential and unpublished) (dated Mar. 3, 2005; dated Oct. 10, 2006).
3 pages from website www.offshore-mag.com, printed Nov. 16, 2011.
Owen Oil Tools, Technical Manual, Hydraulic Tubing Drain, revised Nov. 2007.
Protest filed in Applicants' related Canadian Patent Application on Dec. 21, 2011.
First Amended Statement of Claim dated Oct. 3, 2012, filed in Applicants' related Canadian Patent Application.
Entries from the Schlumberger Oilfield Glossary for "pin", "box", and "threadform", accessed Sep. 3, 2013 via www.glossary.oilfield.slb.com.
Apex Advanced Solutions Safety Torque Tubing Drain; undated. (Tab 176).
Dura Productss—Pump Parts and Accessories Catalogue (Selected Portions); various dates. (Tab 177).
Dura Products—Hydraulic Tubing Drain; undated. (Tab 178).
Owen Oil Tubes—Technical Manual; Nov. 2007 Rev 3. (Tab 180).
Premium Artificial Lift Systems, Ltd.—Premium Tubing Drain Valve; undated. (Tab 181).
TechWest Inc., Catalogue (Selected Portions); undated. (Tab 182).
Tri-Alta Oilfield Industries Ltd.—Tubing Drains (Type S); undated. (Tab 183).
Western Oilfield Specialties Corp.—Type "S" Tubing Drain; undated. (Tab 184).
Plainsman PowerTorq Tubing Drain / SB Tubing Drain, Aug.-Sep. 2012. (Tab 185).
Plainsman Type SB Tubing Drain; Aug.-Sep. 2005. (Tab 186).
Plainsman Type SB Tubing Drain; undated. (Tab 187).
Plainsman PowerTorq Tubing Drain (Features); undated. (Tab 188).
Plainsman PowerTorq Tubing Drain (Improved Features); undated. (Tab 189).
Plainsman PowerTorq Tubing Drain (Materials of Construction); undated. (Tab 190).
Plainsman Mfg. Inc.—Tubing Drain (4 1/2") Drawing; March—Mar. 2005. (Tab 191).
Plainsman Mfg. Inc.—Tubing Drain (5 1/2") Drawing; October—Oct. 2006. (Tab 192).

(56) References Cited

OTHER PUBLICATIONS

Plainsman Mfg. Inc.13 Tubing Drain (5 1/2") Drawing; date illegible. (Tab 193).
Photograph of Tubing Drain sold by Weatherford; undated. (Tab 194).
Photograph of SB Tubing Drain; undated. (Tab 195).
Photograph of a 4 1/2" Type SB Tubing Drain; undated. (Tab 196).
Photograph of a 4 1/2" Type SB Tubing Drain; undated. (Tab 197).
Photograph of a 4 1/2" Type SB Tubing Drain; undated. (Tab 198).
Hawkeye Industries Inc.—Tubing Drain; undated. (Tab 179).
Photograph of a Plainsman Type SB Tubing Drain, a Tubing Drain, and an Extended SB Tubing Drain; undated. (Tab 202).
Photograph of a Plainsman Type SB Tubing Drain, a Tubing Drain, and an Extended SB Tubing Drain; undated. (Tab 203).
Photograph of a Plainsman Type SB Tubing Drain; undated. (Tab 204).
Photograph of a Plainsman Type SB Tubing Drain; undated. (Tab 205).
Photograph of a Plainsman Type SB Tubing Drain; undated. (Tab 206).
Photograph of a Tubing Drain; undated. (Tab 207).
Photograph of a 4 1/2" Type SB Tubing Drain next to different tubing drain; undated. (Tab 208).
Photograph of a 4 1/2" Type SB Tubing Drain next to a different tubing drain; undated. (Tab 209).
Photograph of a 4 1/2" Type SB Tubing Drain in a Power Tong; undated. (Tab 210).
Photograph of a 4 1/2" Type SB Tubing Drain in a Power Tong; undated. (Tab 211).
Photograph of a 4 1/2" Type SB Tubing Drain in a Power Tong; undated. (Tab 212).
Photograph of a 4 1/2" Type SB Tubing Drain in a Power Tong; undated. (Tab 213).
Photograph of a 4 1/2" Type SB Tubing Drain in a Power Tong; undated. (Tab 214).
Photograph of a 4 1/2" Type SB Tubing Drain in a Power Tong; undated. (Tab 215).
Photograph of a Power Tong; undated. (Tab 216).
Oil Country Manufacturing Inc. Catalogue; Apr. 17, 2002. (Tab 1).
Excerpt from Oil Country Manufacturing Inc. Catalogue; undated. (Tab 2).
TP82 Owner's Manual; undated. (Tab 3).
Rig Tool Products Catalogue; 2012. (Tab 4).
Norske Shell Production Test Programme for Internal Gravel Pack Completion; Apr. 14, 1983. (Tab 6).
HYDRA-JAR; Double Acting Hydraulic Drilling Jar;—Operation Manual; May 1998. (Tab 23).
Western Oilfield; Type "S" Tubing Drain; undated. (Tab 24).
Owen Oil Tools—Hydraulic Tubing Drain—Technical Manual; Nov. 2007. (Tab 25).
Offshore; Field-tested power tong handles all sizes of casing, drillpipe, tubing; Nov. 16, 2011. (Tab 26).
Plainsman Mfg., Inc.; 4 1/2" Tubing Drain; Assembly Drawing; Apr. 19, 2001. (Tab 34).
Dog Nut Preventative Back-Off; Drawing; Jun. 23, 2005. (Tab 41).
MISSION Products "Dies and Inserts Catalog" (Natiional Oilwell Varco); 2012. (Tab 5).

* cited by examiner

WELL TUBING HANGER ADAPTED FOR USE WITH POWER TONGS AND METHOD OF USING SAME

CROSS-REFERENCE TO RELATED APPLICATIONS

This application claims the priority benefit under 35 U.S.C. §120 as a continuation of U.S. patent application Ser. No. 13/132,490, filed 2 Jun. 2011, and having the same title and inventive entity, which application in turn is a National Stage filing under 35 U.S.C. §371 of International PCT Application Serial No. PCT/CA2009/001759, having an international filing date of 4 Dec. 2009, and claims the priority of Canadian Patent Application Serial No. 2,646,231, filed 5 Dec. 2008. The complete disclosures of each of the aforementioned and/or priority applications are hereby incorporated by reference for all purposes.

BACKGROUND

Field of the Disclosure

The present invention relates to a well tool adapted to be connected with and disconnected from a well tubing using a power tong device.

Brief Discussion of Related Art

A tubing string for use in a wellbore is often constructed from a number of lengths (i.e., joints) of well tubing which are connected together end to end. A typical length of well tubing consists essentially of a pipe or conduit having a connector at each end to facilitate connection with other lengths of well tubing.

Lengths of well tubing may therefore be connected together by using the connectors at their ends to make connections between them. The connectors at the ends of lengths of well tubing may be comprised of threaded connectors, and the connections between lengths of well tubing may be comprised of threaded connections.

In some cases, two lengths of well tubing may include complementary threaded pin and box connectors at their ends which permit the lengths of well tubing to be connected together directly in order to provide the connection. In other cases, two lengths of well tubing may include similar threaded pin or box connectors at their ends and the connection between the lengths of well tubing may be completed by a threaded coupler which is interposed between the lengths of well tubing. A threaded connection between lengths of well tubing may therefore typically comprise the threaded connectors at the ends of the lengths of well tubing and a threaded coupler which may be needed in order to complete the connection.

Where a connection between lengths of well tubing includes a coupler, the coupler may include a torque shoulder or a torque ring against which the ends of the lengths of well tubing abut and which provides a small separation between the ends of the connected lengths of well tubing.

One common type of well tubing is an external upset end (EUE) well tubing. A typical length of EUE well tubing has a substantially constant internal diameter along the length, but has external upsets at the ends which provide an increased thickness of material from which to form the connectors. A typical EUE well tubing connector is an EUE pin connector. A connection between lengths of EUE well tubing is typically comprised of the EUE pin connectors at the ends of adjacent lengths of well tubing and a threaded coupler which completes the connection.

In order to ensure reliable connections between lengths of well tubing, a specified amount of torque is preferably applied to the threaded connections as the tubing string is assembled.

In order to facilitate the connection and disconnection of lengths of well tubing and in order to apply the desired torque to the connections between lengths of well tubing, a power tong device is often used. The use of the power tong device permits the connections between the well tubing to be made up in compliance with the industry standard or tubing torque specifications, such as the American Petroleum Institute ("API") specifications.

The power tong device typically operates by gripping two adjacent lengths of well tubing and applying torque as may be required either to make up or break the connection between them. More particularly, the power tong device typically operates by gripping above and below the connection between the adjacent lengths of well tubing and applying opposing rotational forces to the lengths of well tubing in order to connect or disconnect the lengths of well tubing.

In this regard, the power tong device may typically include a powered tong, a back-up tong and a support structure or support system for supporting and positioning the tongs relative to each other during use. The powered tong is typically positioned above the back-up tong and grips and rotates the length of well tubing above the connection while the back-up tong grips the length of well tubing below the connection in order to resist the rotation of the lower length of well tubing relative to the upper length of well tubing.

Both the powered tong and the back-up tong typically include one or more clamps or jaws for gripping the lengths of well tubing. The powered tong and the back-up tong are typically configured or shaped to be compatible with well tubing and couplers so that the well tubing and the couplers are not crushed or damaged when gripped.

In particular, threaded connectors and couplers are particularly susceptible to crushing or damage during use of the power tong device. Therefore, the powered tong and the back-up tong must be placed with care on the lengths of well tubing, preferably out of contact with the connectors and preferably out of contact with any coupler which may be present. In the case of EUE well tubing, the powered tong and the back-up tong are also preferably placed out of contact with the upset ends of the well tubing so that the tongs can engage a relatively uniform cross-section of the well tubing.

The support structure of the power tong device is typically configured to maintain the powered tong and the back-up tong at a predetermined longitudinal distance or "gripping span" relative to each other. The gripping span is the clear distance between the tongs, which is typically the distance between the lower end of the powered tong and the upper end of the back-up tong. The gripping span of the power tong device is typically sufficiently large to enable the powered tong and the back-up tong to grip adjacent lengths of well tubing at locations which are spaced from the threaded connectors and any associated coupler, thereby maintaining the connection between the lengths of well tubing within the gripping span and avoiding damage to the connection by the power tong device. In the case of EUE well tubing, the gripping span of the power tong device is also typically sufficiently large to enable the tongs to grip adjacent lengths of well tubing at locations which are spaced from the upset ends of the lengths of well tubing, thereby maintaining the "upset length" of the connection within the gripping span.

A typical length of a threaded connector on the end of a length of a 3.5 inch size well tubing may be between about 2.5 inches (about 6.35 cm) and about 3 inches (about 7.62 cm).

The length of a threaded connection between lengths of well tubing may be defined by the combined lengths of the threaded connectors and/or by the length of a coupler which is used to complete the connection. A typical length of a threaded connection between lengths of 3.5 inch size well tubing may be between about 5 inches (about 12.7 cm) and about 6 inches (about 15.24 cm).

In the case of EUE well tubing, a typical length of an upset end of a length of 3.5 inch size EUE well tubing may be between about 3.5 inches (about 8.89 cm) and about 4.5 inches (about 11.43 cm) so that the total upset length of a threaded connection between two lengths of 3 5 inch size EUE well tubing may be between about 7 inches (about 17 78 cm) and about 9 inches (about 22.86 cm).

In some typical power tong devices, the gripping span between the powered tong and the back-up tong may be about 11 inches (about 27 94 cm) As a result, a power tong device is typically capable of connecting and disconnecting lengths of 3.5 inch size and smaller well tubing without damaging the threaded connections between them In the case of EUE well tubing, a power tong device is also typically capable of gripping the lengths of 3.5 inch size and smaller well tubing at locations which are spaced from the upset ends.

The tongs of the power tong device typically provide a maximum clearance diameter for objects passing through the tongs The maximum clearance diameter of the tongs is the maximum radial or transverse dimension to which the tongs can be expanded The maximum clearance diameter of the tongs is typically sufficiently large to enable connected lengths of well tubing, including associated couplers, to pass longitudinally through the tongs to facilitate assembly or disassembly of a tubing string.

A typical outside diameter of a length of 3.5 inch size well tubing may be about 3 5 inches (about 8 89 cm) and a typical outside diameter of a coupler which may be used to complete a threaded connection between two lengths of 3 5 inch size well tubing may be about 4.5 inches (about 11.43 cm) In some typical power tong devices, the maximum clearance diameter of the tongs may be about 5 inches (about 12.7 cm) or about 6 inches (about 15.24 cm) As a result, connected lengths of 3 5 inch size and smaller well tubing are typically capable of being passed longitudinally through the tongs of a power tong device The tongs of the power tong device have a tong length The tong length of a tong is the longitudinal length of the surface of the tong which grips the lengths of well tubing A typical tong length for the tongs of a power tong device is about 4 inches (about 10 16 cm) The substantially uniform external surface of a typical length of well tubing (other than the upset ends of an EUE well tubing) constitutes a suitable gripping surface to be gripped by the tongs of a power tong device Examples of various power tong devices are provided by U.S. Pat. No. 7,121,166 issued Oct. 17, 2006 to Drzewiecki, U.S. Pat. No. 7,000,503 issued Feb. 21, 2006 to Dagenais, et al., U.S. Pat. No. 6,082,224 issued Jul. 4, 2000 to McDaniels, et al., U.S. Pat. No. 4,631,987 issued Dec. 30, 1986 to Buck and U.S. Pat. No. 4,084,453 issued Apr. 18, 1978 to Eckel.

In addition to lengths of well tubing, a tubing string may include one or more well tools. Well tools may typically be connected at the ends of the tubing string or may be interposed in the tubing string between lengths of well tubing and/or other well tools. It may therefore be necessary to connect such well tools into the tubing string or to disconnect such well tools from the tubing string.

For instance, there may be a need to connect or disconnect a hanger, often referred to as a "tubing hanger", to an upper end of the tubing string in order to support the tubing string in a wellbore. Further, there may be a need to connect or disconnect a drain, often referred to as a "tubing drain", within a tubing string between lengths of well tubing to permit the draining of fluid from within the tubing string when required.

In order to facilitate connection into the tubing string, a well tool may be comprised of one or more connectors which are compatible with the connectors on the lengths of well tubing. For example, a typical well tool may be comprised of one or more threaded connectors such as a threaded pin connector and/or a threaded box connector. As with the threaded connections between lengths of well tubing, it is often desirable for a specified amount of torque to be applied to a threaded connection between a well tool and a length of well tubing.

A typical well tool of the type which may typically be connected into a tubing string may be configured in a manner which renders difficult or impossible the safe and effective use of a power tong device to make up or break the connection between the well tool and a length of well tubing.

More particularly, the well tool may be comprised of components and/or structures which do not enable a power tong device to safely and effectively grip both the well tool and the length of well tubing in a manner which does not risk damage to either the well tool or the length of well tubing.

As a first example, such components and/or structures may not accommodate the gripping span of the power tong device because the presence of such components and/or structures lengthens the distance between an appropriate gripping surface on the well tool and the end of the well tool which is to be connected with the length of well tubing. As a result, the gripping span of the power tong device may be insufficient to enable the connection between the well tool and the length of well tubing to be located within the gripping span. In the case of EUE well tubing and well tools having EUE connectors, the gripping span of the power tong device may be insufficient to enable the upset length of the connection between the well tool and the length of well tubing to be located within the gripping span.

As a second example, such components and/or structures may not accommodate the maximum clearance diameter of the tongs of the power tong device because the presence of such components and/or structures results in the radial or transverse dimension of the well tool being greater than the maximum clearance diameter.

In cases where the configuration of a well tool renders the use of a power tong device to be impractical in order to connect the well tool into or disconnect the well tool from a tubing string, it is common to make up or break a connection between the well tool and a length of well tubing manually. It may, however, be difficult to provide a suitable amount of torque without the use of a power tong device. This frequently results in the use of loctite or other adhesives to complete connections, which connections may then be very difficult to break when necessary. Safety at the wellsite may also be compromised if a power tong device cannot be used.

There is therefore a need in the industry for a well tool which is adapted to be connected with and disconnected from a well tubing using a power tong device. There is a particular need in the industry for a tubing hanger for supporting a tubing string within a wellbore which is adapted to be connected with and disconnected from a well tubing using a power tong device. There is also a particular need in the industry for a tubing drain which permits fluid to be drained from a tubing string and which is adapted to be connected with and disconnected from a well tubing using a power tong device.

Examples of tubing hangers which are known in the art are provided by Canadian Patent Application No. 2,215,755 published on Aug. 7, 1998 by McPhie et. al., U.S. Pat. No. 1,931,024 issued Oct. 17, 1933 to Howard, U.S. Pat. No. 2,148,327 issued Feb. 21, 1939 to Smith et. al., U.S. Pat. No. 2,274,477 issued Aug. 24, 1939 to Howard et. al., U.S. Pat. No. 3,001,803 issued May 7, 1956 to Watts et. al., U.S. Pat. No. 4,690,221 issued Sep. 1, 1987 to Ritter, Jr. and U.S. Pat. No. 6,019,175 issued Feb. 1, 2000 to Haynes.

Examples of tubing drains which are known in the art are provided by U.S. Pat. No. 3,552,412 issued Jan. 5, 1971 to Hagar et. al., U.S. Pat. No. 3,981,360 issued Sep. 21, 1976 to Marathe, U.S. Pat. No. 4,286,662 issued Sep. 1, 1981 to Page, Jr., U.S. Pat. No. 6,591,915 issued Jul. 15, 2003 to Burris et. al., U.S. Pat. No. 6,752,212 issued Jun. 22, 2004 to Burris et. al. and U.S. Publication 2004/0216867 A1 published on Nov. 4, 2004 by Burris et. al.

None of these examples are specifically directed at providing a well tool which is configured to be connected with or disconnected from a well tubing using a power tong device.

SUMMARY

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention relates to a well tool which is adapted to be connected with and disconnected from a well tubing using a power tong device.

The ability to use the power tong device to facilitate the connection between the well tool and the well tubing may permit the connection to be made up in compliance with API tubing torque specifications. In addition, the ability to use the power tong device may avoid the need to use pipe wrenches, snipes, winch lines or other manual tools or mechanism for providing the connection and disconnection between the well tool and the well tubing. Thus, the configuration of the well tool and the ability to utilize the power tong device may enhance the safety of personnel making and breaking the connections.

The well tool may be comprised of or may consist essentially of any structure, device or apparatus of the type which may be connected with a well tubing. In some embodiments, the well tool may be connected with one or more lengths of well tubing so that the well tool is a component of a tubing string. The tubing string may have a proximal end which is adapted to be positioned at or near a ground surface, and the tubing string may have a distal end which is adapted to be positioned within a wellbore. The well tool may be connected at an end of a tubing string or the well tool may be interposed between lengths of well tubing and/or other well tools.

By way of non-limiting examples, the well tool may be comprised of or may consist essentially of a pump, a packer, a measuring instrument, a valve, a testing tool, a tubing hanger, a strainer, or a tubing drain.

In some exemplary embodiments described herein, the well tool may be comprised of or may consist essentially of a tubing hanger. In some exemplary embodiments described herein, the well tool may be comprised of or may consist essentially of a tubing drain.

The well tool is adapted to be connected with and disconnected from a well tubing using a power tong device as a result of the configuration of the well tool. The configuration of the well tool provides an amount of compatibility between the well tool and the power tong device.

The power tong device upon which the configuration of the well tool of the invention is based is of a type which has a pair of tongs, a gripping span between the pair of tongs, and a maximum clearance diameter for an object passing through the tongs.

In an exemplary aspect, the invention is a well tool adapted to be connected with and disconnected from a well tubing using a power tong device of the type having a pair of tongs, a gripping span between the pair of tongs, and a maximum clearance diameter for an object passing through the tongs, the well tool comprising:

a tubular mandrel having a first mandrel end, a second mandrel end, an external mandrel surface, a maximum mandrel diameter, and defining a mandrel bore, wherein the maximum mandrel diameter is no greater than the maximum clearance diameter, wherein the tubular mandrel is comprised of a first mandrel connector located at the first mandrel end which is adapted for connecting the tubular mandrel with a first well tubing in order to provide a first connection between the tubular mandrel and the first well tubing, wherein the external mandrel surface defines a tong gripping surface which is located between the first mandrel end and the second mandrel end, and wherein the tubular mandrel is configured so that when the tong gripping surface and the first well tubing are gripped by the power tong device in order to connect the tubular mandrel with the first well tubing the first connection is located within the gripping span.

In some embodiments, the first connection may be comprised of or may consist essentially of a first threaded connection so that the first mandrel connector is comprised of a threaded connector. In some embodiments, the first mandrel connector may be comprised of an external upset end (EUE) connector. In some embodiments, the first mandrel connector may be comprised of a pin connector. In some embodiments, the first mandrel connector may be comprised of a box connector. In some embodiments, the first mandrel connector may be comprised of an external upset end (EUE) pin connector.

In some embodiments, each of the tongs in the pair of tongs of the power tong device may have a tong length, the tong gripping surface may have a gripping surface length, and the gripping surface length may be greater than the tong length.

In some embodiments, the maximum clearance diameter of the power tong device with which the well tool is intended to be used is about 6 inches (about 15.24 cm) so that the maximum mandrel diameter is no greater than about 6 inches (about 15.24 cm).

In some embodiments, the maximum clearance diameter of the power tong device with which the well tool is intended to be used is about 5 inches (about 12.7 cm) so that the maximum mandrel diameter is no greater than about 5 inches (about 12.7 cm).

A length of well tubing and/or a well tool may be comprised of a connector at each end. In some cases, the connectors on the ends of a length of well tubing or well tool may have a length which is between about 2.5 inches (about 6.35 cm) and about 3 inches (about 7.62 cm).

The tong gripping surface may have a first gripping surface end and a second gripping surface end, wherein the first gripping surface end is between the first mandrel end and the second gripping surface end, and wherein the second gripping surface end is between the second mandrel end and the first gripping surface end. The tubular mandrel may have a first span length which is between the first gripping surface end and the first mandrel end, and the tubular mandrel may have a second span length which is between the second gripping surface end and the second mandrel end.

In configuring the well tool of the invention, the first span length and/or the second span length is limited by the gripping span of the power tong device. In configuring the well tool of the invention, the first span length and/or the second span length may also be limited by the length of the connectors on the well tubing and/or other well tools with which the well tool of the invention will be connected, by the length of a coupler which may be used to connect the well tool of the invention with well tubing and/or other well tools, and/or by the length of the upset ends on the well tubing and/or other well tools with which the well tool of the invention will be connected.

In some embodiments, the well tool of the invention may be configured so that the first span length is no greater than the difference between the gripping span of the power tong device and the length of the connector on the well tubing or other well tool with which the well tool of the invention will be connected. In some embodiments, the well tool of the invention may be configured so that the second span length is no greater than the difference between the gripping span of the power tong device and the length of the connector on the well tubing or other well tool with which the well tool of the invention will be connected.

In some embodiments, the well tool of the invention may be configured so that the first span length is no greater than the difference between the gripping span of the power tong device and one half of the length of a coupler which will be used to complete the connection between the well tool of the invention and a length of well tubing or other well tool. In some embodiments, the well tool of the invention may be configured so that the second span length is no greater than the difference between the gripping span of the power tong device and one half of the length of a coupler which will be used to complete the connection between the well tool of the invention and a length of well tubing or other well tool.

In some embodiments, the well tool of the invention may be configured so that the first span length is no greater than the difference between the gripping span of the power tong device and the length of the upset end on the well tubing or other well tool with which the well tool of the invention will be connected. In some embodiments, the well tool of the invention may be configured so that the second span length is no greater than the difference between the gripping span of the power tong device and the length of the upset end on the well tubing or other well tool with which the well tool of the invention will be connected.

In some embodiments, the gripping span of the power tong device with which the well tool of the invention may be used may be about 11 inches (about 27.94 cm).

In some embodiments in which the gripping span of the power tong device may be about 11 inches (about 27.94 cm) and the well tool of the invention is configured to be used with 3.5 inch size or smaller well tubing, the well tool of the invention may be configured so that the first span length is no greater than about 8 inches (about 20.32 cm) and/or so that the second span length is no greater than about 8 inches (about 20.32 cm), so that the connection between the well tool of the invention and a length of well tubing may be located within the gripping span.

In some embodiments in which the gripping span of the power tong device may be about 11 inches (about 27.94 cm) and the well tool of the invention is configured to be used with 3.5 inch size or smaller well tubing, the well tool of the invention may be configured so that the first span length is no greater than about 7 inches (about 17.78 cm) and/or so that the second span length is no greater than about 7 inches (about 17.78 cm), so that both the connection between the well tool of the invention and a length of well tubing and the upset end of the length of well tubing may be located within the gripping span.

In some embodiments in which the gripping span of the power tong device may be about 11 inches and the well tool of the invention is configured to be used with 3.5 inch size or smaller well tubing, the well tool of the invention may be configured so that the first span length is no greater than about 6.5 inches (about 16.51 cm) and/or so that the second span length is no greater than about 6.5 inches (about 16.51 cm), so that both the connection between the well tool of the invention and a length of well tubing and the upset end of the length of well tubing may be located within the gripping span.

As indicated, in some embodiments, the well tool of the invention is configured to be used with 3.5 inch size or smaller well tubing, such as 2⅜ inch size well tubing or 2⅞ inch size well tubing. In some embodiments, this configuration may also be used with 4.5 inch size well tubing. However, if required, some of the dimensions of the well tool may be adjusted in accordance with the principles discussed herein.

In some embodiments, the well tool may be comprised of or may consist essentially of a tubing hanger which may be directly or indirectly connected with one or more lengths of well tubing. The tubing hanger may be adapted to be connected as a component of a tubing string in order to provide an interface between the tubing string and a well for supporting the tubing string in the well. In some embodiments, the tubing hanger may be connected into a tubing string at or near a proximal end of the tubing string.

The tubing hanger may be adapted to engage a structure which is located at or near a ground surface in order to enable the tubing string to be supported in the well. In some embodiments, the structure may be comprised of a tubing head so that the tubing hanger may be adapted to engage the tubing head in order to enable the tubing string to be supported in the well.

In some embodiments in which the well tool may be comprised of or may consist essentially of a tubing hanger, the tubular mandrel may be further comprised of a second mandrel connector, and the well tool may further comprise:

a tubular shell having a first shell end, a second shell end, and defining a shell bore for receiving the tubular mandrel therein, wherein the tubular shell has an external shell surface, wherein the external shell surface defines a tubing head engagement surface which is adapted to engage a tubing head, wherein the tubular shell is comprised of a shell connector for connecting with the second mandrel connector in order to provide a second connection between the tubular mandrel and the tubular shell, and wherein the first mandrel end and the tong gripping surface extend from the first shell end when the tubular mandrel is received in the shell bore and the tubular mandrel is connected with the tubular shell.

In some embodiments in which the well tool may be comprised of or may consist essentially of a tubing hanger, the well tool may be further comprised of a locking mechanism for maintaining the tubular mandrel and the tubular shell in a desired relative position when the tubular mandrel and the tubular shell are connected with each other. The locking mechanism may be comprised of any structure, device or apparatus which is suitable for maintaining the tubular mandrel and the tubular shell in the desired relative position.

In some embodiments, the locking mechanism may be comprised of a recess associated with one of the tubular mandrel and the tubular shell and a lug associated with the other of the tubular mandrel and the tubular shell. The lug may be movable into engagement with the recess when the tubular mandrel and the tubular shell are connected with each other at a desired relative position in order to maintain the tubular mandrel and the tubular shell at the desired relative position.

In some embodiments, the lug may be comprised of a set screw threadably associated with the tubular shell, the recess may be associated with the tubular mandrel, and the set screw may be movable into engagement with the recess in order to maintain the tubular mandrel and the tubular shell at the desired relative position.

In some embodiments in which the well tool may be comprised of or may consist essentially of a tubing hanger, the second connection may be comprised of or may consist essentially of a second threaded connection so that the second mandrel connector and the shell connector are comprised of threaded connectors. In some embodiments, the second mandrel connector may be comprised of a pin connector which is defined by the external mandrel surface. In some embodiments, the shell connector may be comprised of a box connector which is defined by the shell bore.

In some embodiments in which the well tool may be comprised of or may consist essentially of a tubing hanger, the first threaded connection and the second threaded connection may be threaded in opposite directions. In some embodiments, the second threaded connection may be threaded in a left handed direction.

In some embodiments in which the well tool may be comprised of or may consist essentially of a tubing hanger, the well tool may be further comprised of a shell seal device associated with the external shell surface, for providing a seal between the tubular shell and the tubing head. The shell seal device may be comprised of any structure, device or apparatus which is suitable for providing the seal between the tubular shell and the tubing head.

In some embodiments, the shell seal device may be comprised of at least one O-ring type seal and the external shell surface may define at least one corresponding O-ring groove for containing the O-ring type seal or seals.

In some embodiments in which the well tool may be comprised of or may consist essentially of a tubing hanger, the well tool may be further comprised of a mandrel seal device associated with at least one of the external mandrel surface and the shell bore, for providing a seal between the tubular mandrel and the tubular shell. The mandrel seal device may be comprised of any structure, device or apparatus which is suitable for providing the seal between the tubular mandrel and the tubular shell.

In some embodiments, the mandrel seal device may be comprised of at least one O-ring type seal and the external mandrel surface and/or the shell bore may define at least one corresponding O-ring groove for containing the O-ring type seal or seals. In some embodiments, the external mandrel surface may define the at least one corresponding O-ring groove.

In some embodiments in which the well tool may be comprised of or may consist essentially of a tubing hanger, the tubular mandrel may be further comprised of a third mandrel connector which is adapted for connecting the tubular mandrel with a lifting member in order to provide a third connection between the tubular mandrel and the lifting member. In some embodiments, the third mandrel connector may be located at or adjacent to the second mandrel end.

In some embodiments, the third connection may be comprised of a third threaded connection so that the third mandrel connector is comprised of a threaded connector. In some embodiments, the third mandrel connector may be defined by the mandrel bore. In some embodiments, the third mandrel connector may be comprised of a box connector. In some embodiments, the third mandrel connector may be comprised of an external upset end (EUE) box connector.

In some embodiments, the well tool may be comprised of or may consist essentially of a tubing drain which may be directly or indirectly connected with one or more lengths of well tubing. The tubing drain may be adapted to be connected as a component of a tubing string in order to provide a capability to drain the tubing string. In some embodiments, the tubing drain may be adapted to be connected into a tubing string at or near a distal end of the tubing string.

The tubing drain may be comprised of a drain and a drain closing device. The drain closing device may be arranged to close the drain. The drain closing device may be actuatable to open the drain.

In some embodiments in which the well tool may be comprised of or may consist essentially of a tubing drain, the tubular mandrel may be further comprised of a second mandrel connector located at the second mandrel end which is adapted for connecting the tubular mandrel with a second well tubing in order to provide a second connection between the tubular mandrel and the second well tubing, the tubular mandrel may be configured so that when the tong gripping surface and the second well tubing are gripped by the power tong device in order to connect the tubular mandrel with the second well tubing the second connection is located within the gripping span, the tubular mandrel may define a drain extending between the external mandrel surface and the mandrel bore, and the well tool may further comprise:

(b) an actuatable drain closing device, wherein the drain closing device is arranged to close the drain, and wherein the drain closing device is actuatable to open the drain.

The drain closing device may be comprised of any structure, device or apparatus which is suitable for closing the drain. The drain closing device may be actuated to open the drain in any suitable manner. In some embodiments in which the well tool may be comprised of or may consist essentially of a tubing drain, the drain closing device may be actuatable to open the drain by providing an actuating pressure in the mandrel bore.

In some embodiments, the drain closing device may be comprised of a burst plug and the burst plug may be configured to rupture to open the drain when the actuating pressure is provided in the mandrel bore.

In some embodiments, the drain closing device may be comprised of a slidable sleeve. The slidable sleeve may surround the tubular mandrel. The slidable sleeve may cover the drain in order to close the drain. The slidable sleeve may be slidable relative to the tubular mandrel in order to uncover the drain. The slidable sleeve may be slidable to uncover the drain when the actuating pressure is provided in the mandrel bore. The actuating pressure may exert an actuating force on the slidable sleeve which causes the slidable sleeve to slide to uncover the drain. One or more shear members may connect the slidable sleeve with the tubular mandrel, and the actuating force may cause the shear members to shear in order to permit the slidable sleeve to slide to uncover the drain. The tubing hanger may be further comprised of a sleeve seal device for providing a seal between the external mandrel surface and the slidable sleeve.

In some embodiments, the drain may be comprised of a single drain port. In some embodiments, the drain may be comprised of a plurality of drain ports. In some embodiments, the drain may be comprised of a plurality of drain ports which are circumferentially spaced around the tubular mandrel.

A drain port or a plurality of drain ports may have a major dimension and a minor dimension. The major dimension may be larger than the minor dimension. The drain port or the plurality of drain ports may be arranged so that the minor dimension extends in a direction which is substantially parallel with a longitudinal axis of the tubing drain which extends between the first mandrel end and the second mandrel end.

In some embodiments in which the well tool may be comprised of or may consist essentially of a tubing drain, the second connection may be comprised of or may consist essentially of a second threaded connection so that the second mandrel connector is comprised of a threaded connector. In some embodiments, the second mandrel connector may be comprised of an external upset end (EUE) connector. In some embodiments, the second mandrel connector may be comprised of a pin connector. In some embodiments, the second mandrel connector may be comprised of a box connector. In some embodiments, the second mandrel connector may be comprised of an external upset end (EUE) pin connector.

BRIEF DESCRIPTION OF THE DRAWINGS

Embodiments of the invention will now be described with reference to the accompanying drawings, in which.

DETAILED DESCRIPTION

Figure 1:
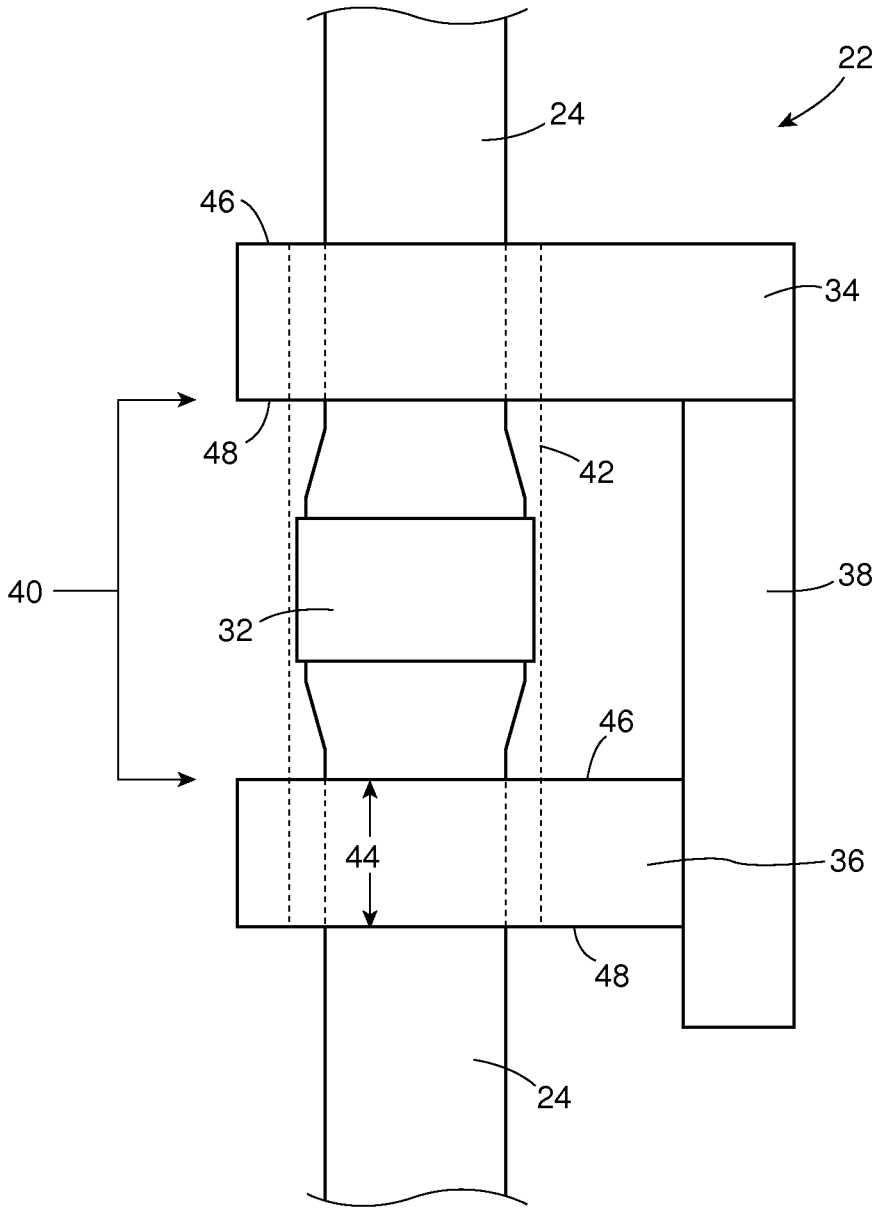
Figure 1 Prior Art
FIG. 1 is a schematic diagram of a power tong device known in the art of the type having a pair of tongs.

Referring to FIGS. 2-10, a well tool (20) is provided which is adapted to be connected and disconnected from a well tubing using a power tong device (22) of the type shown in FIG. 1.

Figure 5:
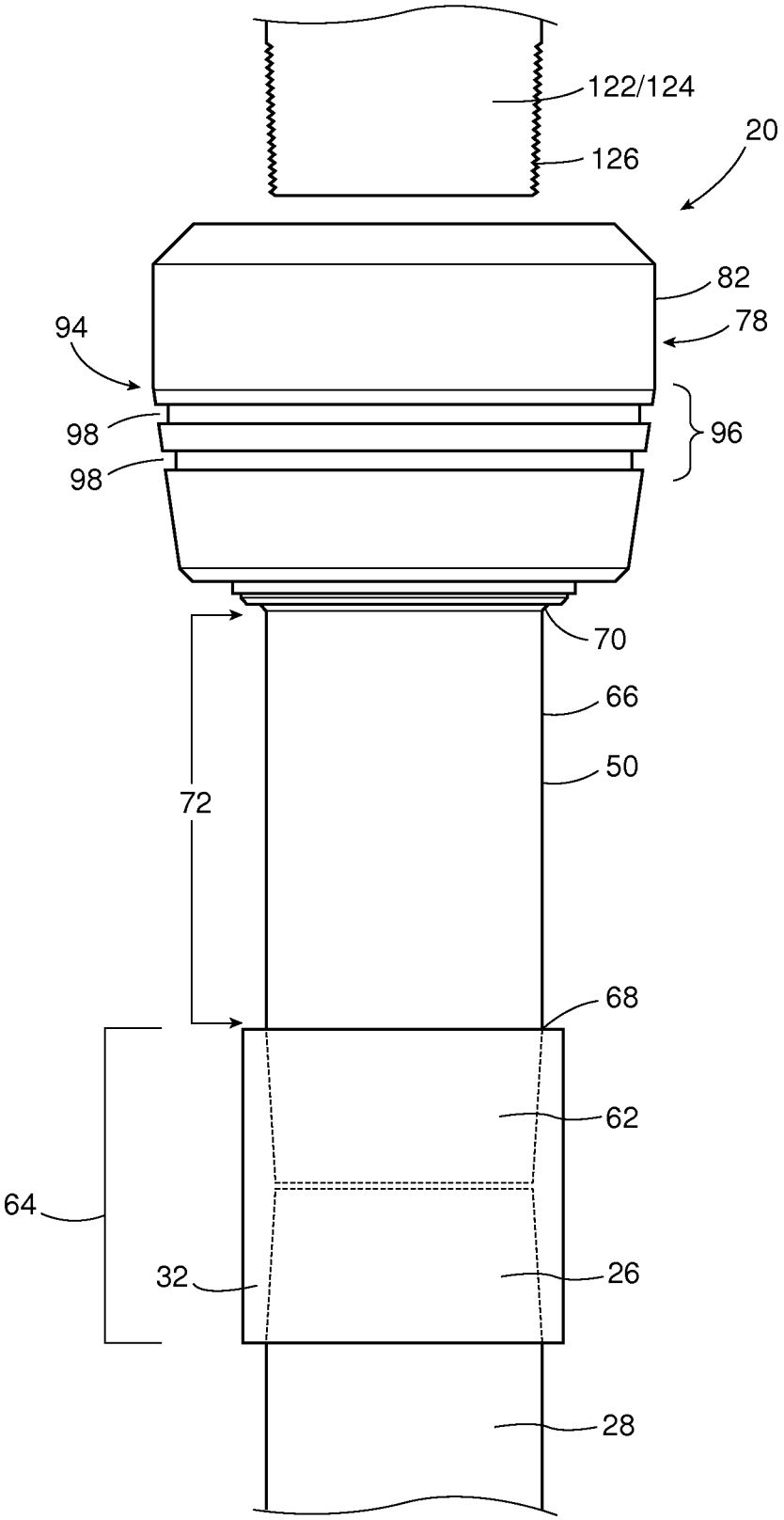
FIG. 5 is side view of the tubing hanger shown in FIG. 2 connected with a first well tubing and showing a lifting member for use with the tubing hanger.
Figure 9:
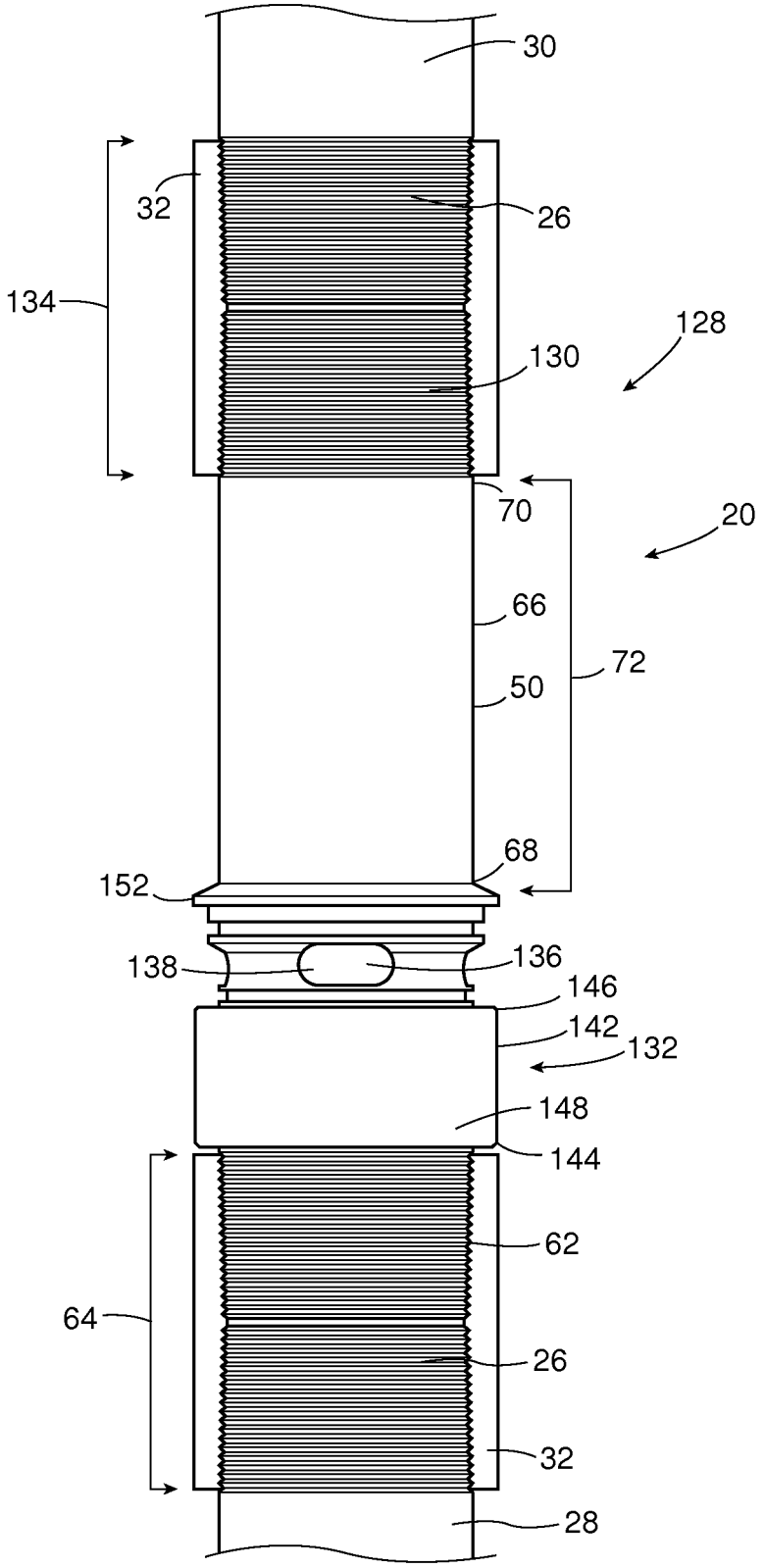
FIG. 9 is side view of the tubing drain shown in FIG. 6 connected with a first well tubing and a second well tubing.

Referring to FIG. 1, the power tong device (22) is shown being utilized for the connection and disconnection of adjacent lengths or sections of well tubing (24), particularly 3.5 inch size EUE well tubing, wherein the well tubing provides a connector (26) at each end thereof. Referring to FIG. 5, a first well tubing (28), having a connector (26) at an end thereof, is shown connected with an exemplary embodiment of the well tool (20). Referring to FIG. 9, the first well tubing (28) and a second well tubing (30), also having a connector (26) at and end thereof, are shown connected with a further exemplary embodiment of the well tool (20). In these embodiments, the first and second well tubing (28, 30) may each be a length of 3.5 inch size well tubing.

In this exemplary embodiment, the well tool (20) is configured for connection with 3.5 inch size well tubing (28, 30). However, the well tool (20) may also be configured for connection with smaller size well tubing (28, 30), such as 2⅜ inch size well tubing or 2⅞ inch size well tubing, or larger size well tubing (28, 30), such as 4.5 inch size well tubing. If required, some of the dimensions of the well tool (20) may be adjusted in accordance with the general principles and guidelines discussed herein.

Compatible connectors (26) are provided at each end of the first and second well tubing (28, 30) to permit their connection to adjacent ends of other lengths of well tubing (24), as well as to permit their connection to the adjacent ends of the well tool (20) as described further below. In some embodiments, the connectors (26) are comprised of threaded connectors. In this instance, the connections between the first and second well tubing (28, 30) and the well tool (20) are comprised of threaded connections.

In some instances, the well tool (20) may be directly connected with and disconnected from the adjacent first well tubing (28) and/or second well tubing (30) by complementary threaded pin and box connectors at their ends. However, in some other instances, similar threaded pin or box connectors may be provided between adjacent ends of the well tubing (28, 30) and the well tool (20), and the connection may be completed by a collar or by some other coupler interposed therebetween. For instance, as shown in the exemplary embodiments of FIGS. 5 and 9, similar threaded pin connectors at adjacent ends of the well tubing (28, 30) and the well tool (20) are connected or fastened together by a compatible threaded box coupler (32).

The well tool (20) of the within invention is adapted so that a power tong device (22) of the type shown in FIG. 1 may be used to facilitate the connection and disconnection of adjacent threaded ends of the first well tubing (28) and/or the second well tubing (30) with the well tool (20) and to apply a desired amount of torque to the threaded connection therebetween. Further, the ability to use the power tong device (22) to facilitate the connections between the well tool (20) and the well tubing (28, 30) permits the connections to be made up in compliance with the industry standard for tubing torque specifications, particularly API tubing specifications. Otherwise, without the ability to use the power tong device (22), the connections may only be capable of being provided manually to pipe wrench or similar specifications.

In addition to permitting a desired amount of torque to be applied to the threaded connections, the safety of personnel making and breaking the connections may also be enhanced by the ability to utilize the power tong device (22) with the well tool (20). Specifically, the connections and disconnections between the well tool (20) and well tubing (28, 30) may be made without the use of pipe wrenches, snipes, winch lines or other similar tools or mechanisms.

As shown in FIG. 1, the power tong device (22) includes a pair of tongs for gripping or engaging the well tool (20) and well tubing (24). Typically, the pair of tongs is comprised of a powered tong (34) positioned above a back-up tong (36). Further, the power tong device (22) includes a support structure (38) for supporting and positioning the tongs (34, 36) relative to each other during use. Typically, the powered tong (34) is provided to grip and rotate the structure or component above the connection, while the back-up tong (36) is provided to grip the structure or component below the connection.

For example, referring to the exemplary embodiments shown in FIGS. 5 and 9, with respect to the connection between the well tool (20) and the first well tubing (28), the powered tong (34) may be used to grip and rotate the well tool (20) above the connection, while the back-up tong (36) may be used to grip and resist the rotation of the first well tubing (28) below the connection Referring to FIG. 9, with respect to the connection between the second well tubing (30) and the well tool (20), the powered tong (34) may be used to grip and rotate the second well tubing (30) above the connection, while the back-up tong (36) may be used to grip and resist the rotation of the well tool (20) below the connection Further, the powered tong (34) and the back-up tong (36) of the power tong device (22) define a gripping span (40) and a maximum clearance diameter (42) for an object passing through the tongs (34, 36) In addition, each of the tongs (34, 36) has a tong length (44) measured longitudinally between an upper end or uppermost edge (46) and a lower end or lowermost edge (48) of the tong (34, 36) In some typical power tong devices (22), the tong length (44) for each of the powered and back-up tongs (34, 36) is about 4 inches (about 10.16 cm).

The gripping span (40) between the powered and back-up tongs (34, 36) is the longitudinal distance between the tongs (34, 36) Specifically, the gripping span (40) is the distance from the lowermost edge (48) of the powered tong (34) and the uppermost edge (46) of the back-up tong (36) The support structure (38) of the power tong device (22) maintains the powered tong (34) and the back-up tong (36) at the predetermined longitudinal distance or gripping span (40) relative to each other In some typical power tong devices (22) for use with 3.5 inch size well tubing (24), the gripping span (40) may be about 11 inches (about 27.94 cm) The well tool (20) of the within invention is adapted such that the well tool (20) may be connected and disconnected from the first well tubing (28) and/or second well tubing (30) using the power tong device (22) Thus, when the tongs (34, 36) grip the well tubing (28, 30) and the well tool (20) in the manner described above, the threaded connection is positioned within the gripping span (40) defined between the tongs (34, 36) Furthermore, the well tool (20) is adapted such that the tongs (34, 36) grip each of the well tubing (28, 30) and the well tool (20) at a location apart or away from the threaded connector ends/upset ends and coupler (32) in order to avoid causing any damage thereto during use of the power tong device (20).

The maximum clearance diameter (42) of the tongs (34, 36) is the maximum radial or transverse dimension to which the tongs (34, 36) can be expanded to permit an object to pass through the tongs (34, 36) In some typical power tong devices (22) for use with 3 5 inch size well tubing, the maximum clearance diameter of the tongs (34, 36) may be about 5 inches (about 12.7 cm) or about 6 inches (about 15.24 cm). As indicated, the well tool (20) of the within invention is adapted such that the well tool (20) may be connected and disconnected from the first or second well tubing (28, 30) using the power tong device (22). Thus, the well tool (20) is shaped or configured to permit the well tool (20) to pass through the maximum clearance diameter (42) of the tongs (34, 36).

Thus, referring to FIGS. 2, 4-6 and 8-10, in some embodiments of the invention, the well tool (20) is comprised of a tubular mandrel (50). The tubular mandrel (50) has a first mandrel end (52), an opposed second mandrel end (54) and a longitudinal axis (55) which extends between the first and second mandrel ends (52, 54). Further, the tubular mandrel (50) has an external mandrel surface (56) and defines a mandrel bore (58) extending between the first and second mandrel ends (52, 54). In some embodiments, the length of the tubular mandrel (50) longitudinally between the first and second mandrel ends (52, 54) is no greater than about 15 inches (38.1 cm).

In addition, the tubular mandrel (50) has a maximum mandrel diameter (60), being the maximum radial or transverse dimension of the tubular mandrel (50). In this regard, the maximum mandrel diameter (60) is no greater than the maximum clearance diameter (42) of the power tong device (22). Accordingly, in some embodiments, the maximum mandrel diameter (60) is no greater than about 6 inches (about 15.24 cm). In some other embodiments, the maximum mandrel diameter (60) is no greater than about 5 inches (about 12.7 cm).

Further, the tubular mandrel (50) is comprised of a first mandrel connector (62) located at the first mandrel end (52) which is adapted for connecting the tubular mandrel (50) with the first well tubing (28), as shown in FIGS. 5 and 9, in order to provide a first connection (64) between the tubular mandrel (50) and the first well tubing (28). In some embodiments, the first mandrel connector (62) is comprised of a pin connector defined by the external mandrel surface (56) at the first mandrel end (52). Further, in some embodiments, the first connection (64) is a first threaded connection. Thus, the first mandrel connector (62) may be a threaded connector, specifically a threaded pin connector. In particular, the first mandrel connector (62) may be an external upset end ("EUE") pin connector.

The first well tubing (28) has a connector (26) compatible with the first mandrel connector (62) to provide the first connection (64). Thus, for instance, the connector (26) of the first well tubing (28) may be a compatible box connector, and in particular, a threaded box connector. However, in some exemplary embodiments, as shown in FIGS. 5 and 9, the connector (26) of the first well tubing (28) is comprised of a threaded pin connector. Thus, in order to provide the required connection between the threaded pin connector (26) of the first well tubing (28) and the threaded pin connector comprising the first mandrel connector (62), the first connection (64) may further include a compatible or complementary threaded box end coupler (32). Accordingly, in such embodiments, the first mandrel connector (62), the connector (26) of the first well tubing (28) and the coupler (32) may together provide the first connection (64).

Typically, based upon 3.5 inch size well tubing, the length of the connector (26) on the first well tubing (28) may be between about 2.5 inches (about 6.35 cm) and about 3 inches (about 7.62 cm). Similarly, in some embodiments, the length of the first mandrel connector (62) may be between about 2.5 inches (about 6.35 cm) and about 3 inches (about 7.62 cm). Thus, once connected by the coupler (32), the first connection (64) may be between about 5 inches (about 12.7 cm) and about 6 inches (about 15.24 cm) in length. If desired or required to enhance the first connection (64), a torque ring (not shown) or other mechanism for facilitating the connection may be positioned between the first mandrel connector (62) and the connector (26) on the first well tubing (28).

As well, the external mandrel surface (56) defines a tong gripping surface (66) located between the first mandrel end (52) and the second mandrel end (54). The tong gripping surface (66) has a first gripping surface end (68), an opposed second gripping surface end (70) and a gripping surface length (72) defined longitudinally between the first and second gripping surface ends (68, 70). The gripping surface length (72) is greater than the tong length (44) in order to permit one of the powered tong (34) and the back-up tong (34, 36) to engage the tong gripping surface (66) without causing damage to the tubular mandrel (50) when using the power tong device (22). Thus, the gripping surface length (72) may be greater than about 4 inches (about 10.16 cm). In some embodiments, the gripping surface length (82) is about 6 inches (15.24 cm).

As stated, the tong gripping surface (66) is provided for contact with one of the powered tong (34) and the back-up tong (36) when connecting or disconnecting the well tool (20) using the power tong device (22). Further, the tubular mandrel (50) is configured so that when the tong gripping surface (66) and the first well tubing (28) are gripped by the power tong device (22) in order to connect the tubular mandrel (50) of the well tool (20) with the first well tubing (28), the first connection (64) is located within the gripping span (40).

Specifically, in this embodiment, the powered tong (34) grips the tong gripping surface (66) on the tubular mandrel (50), while the back-up tong (36) grips the first well tubing (28) along the length thereof. The first connection (64) provided by the engagement of the first mandrel connector (62), the connector (26) of the first well tubing (28) and the coupler (32) is located within the gripping span (40).

Figure 2:
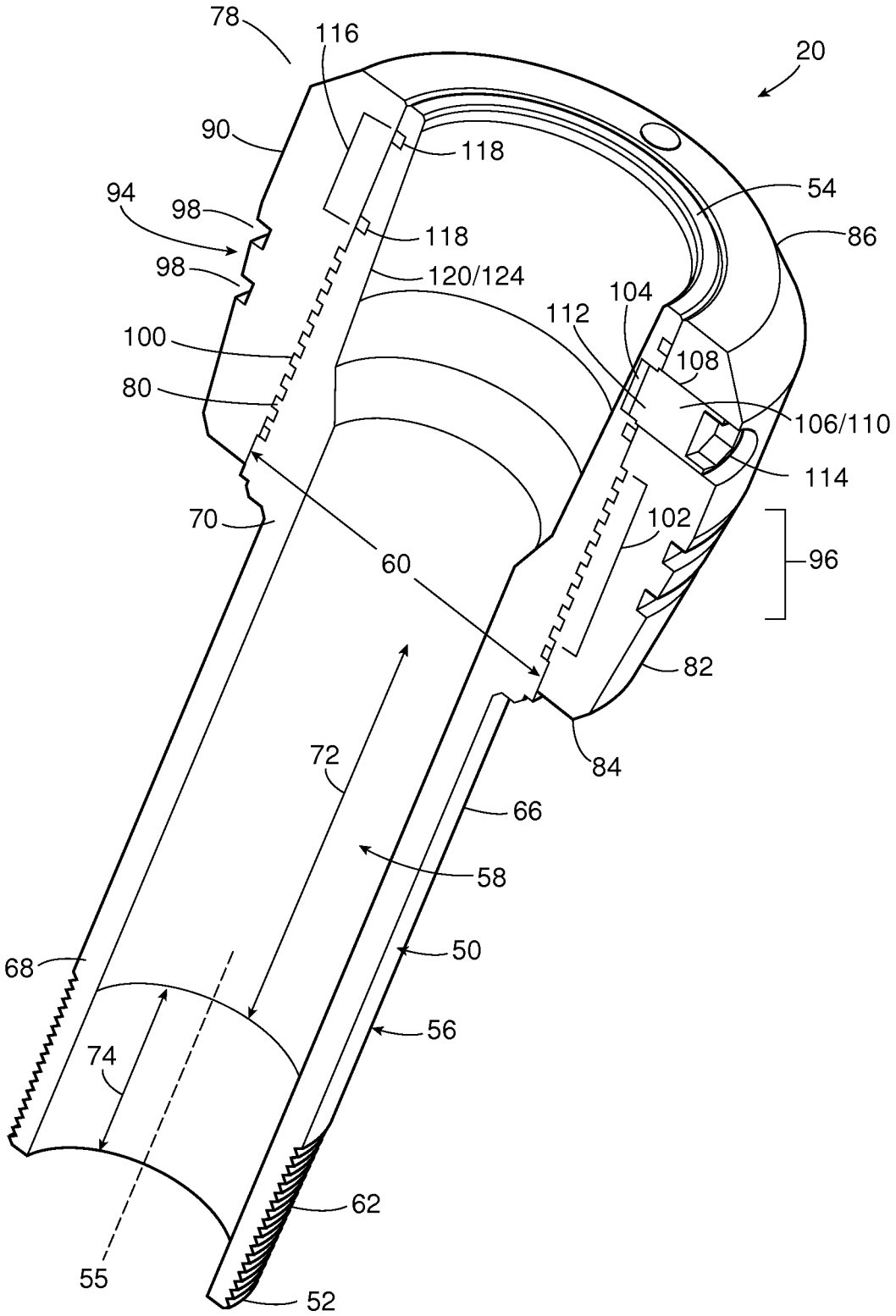
FIG. 2 is a longitudinal sectional view of an embodiment of a well tool adapted to be connected and disconnected from a well tubing using a power tong device of the type shown in FIG. 1, wherein the well tool is a tubing hanger and wherein the well tool is comprised of a tubular mandrel and a tubular shell.
Figure 6:
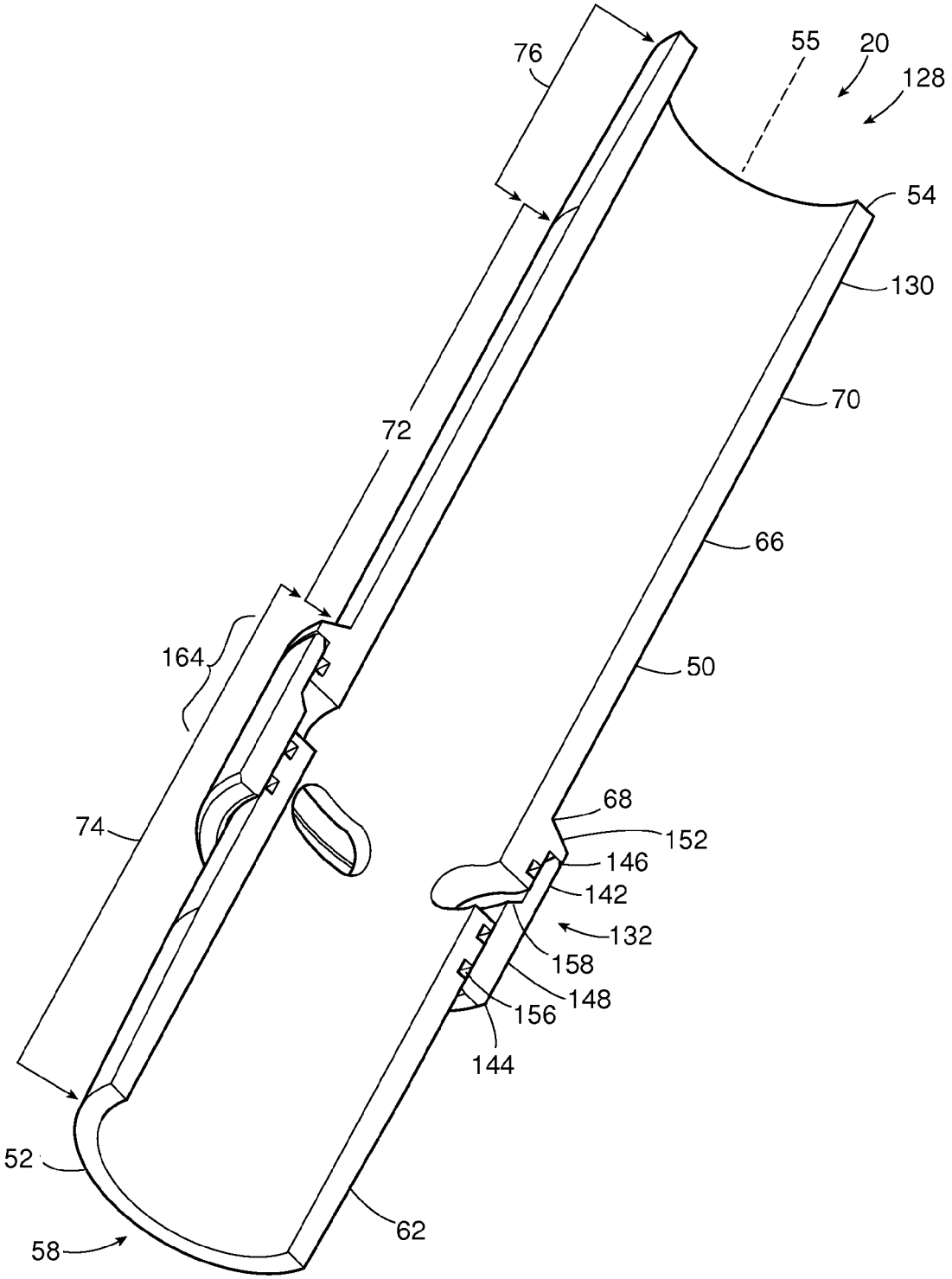
FIG. 6 is a longitudinal sectional view of an embodiment of a well tool adapted to be connected and disconnected from a well tubing using a power tong device of the type shown in FIG. 1, wherein the well tool is a tubing drain, wherein the well tool is comprised of a tubular mandrel and an actuatable drain closing device and wherein the drain closing device is comprised of a slidable sleeve.

Further, as indicated above, the tong gripping surface (66) has a first gripping surface end (68) and a second gripping surface end (70). As shown in FIGS. 2 and 6, the first gripping surface end (68) is positioned or located between the first mandrel end (52) and the second gripping surface end (70), while the second gripping surface end (70) is positioned or located between the second mandrel end (54) and the first gripping surface end (68).

Additionally, in some exemplary embodiments, the tubular mandrel (50) has a first span length (74) defined by the longitudinal distance, i.e. in the direction of the longitudinal axis (55) of the tubular mandrel (50), between the first gripping surface end (68) of the tong gripping surface (66) and the first mandrel end (52). In order to adapt the well tool (20) to permit its connection and disconnection from the first well tubing (28), as shown in FIGS. 5 and 9, the first span length (74) may be no greater than about 8 inches (20.32 cm). However, in some embodiments of the well tool (20), the first span length (74) may be no greater than about 7 inches (about 17.78 cm) or no greater than about 6.5 inches (about 16.51 cm).

Similarly, in some exemplary embodiments, the tubular mandrel (50) has a second span length (76) defined by the longitudinal distance between the second gripping surface end (70) of the tong gripping surface (66) and the second mandrel end (54). In order to adapt the well tool (20) to permit its connection and disconnection from the second well tubing (30), as shown in FIG. 9, the second span length (76) may be no greater than about 8 inches (20.32 cm). However, in some embodiments of the well tool (20), the second span length (76) may be no greater than about 7 inches (about 17.78 cm) or may be no greater than about 6.5 inches (about 16.51 cm).

In some exemplary embodiments of the well tool (20), the well tool (20) is a tubing hanger (78), as shown in FIGS. 2-5. The tubing hanger (78) is typically provided for supporting a tubing string comprised of one or more lengths of well tubing (24) within a wellbore at a tubing head (not shown) provided at the surface. The tubing head provides a bore extending therethrough for receipt of the tubing hanger (78) such that the tubing hanger (78) is supported therein.

Figure 3:
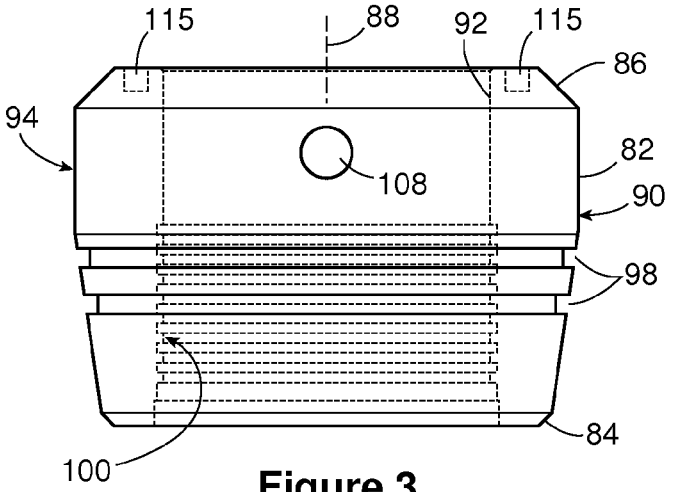
FIG. 3 is a side view of the tubular shell of the tubing hanger shown in FIG. 2, in isolation.
Figure 4:
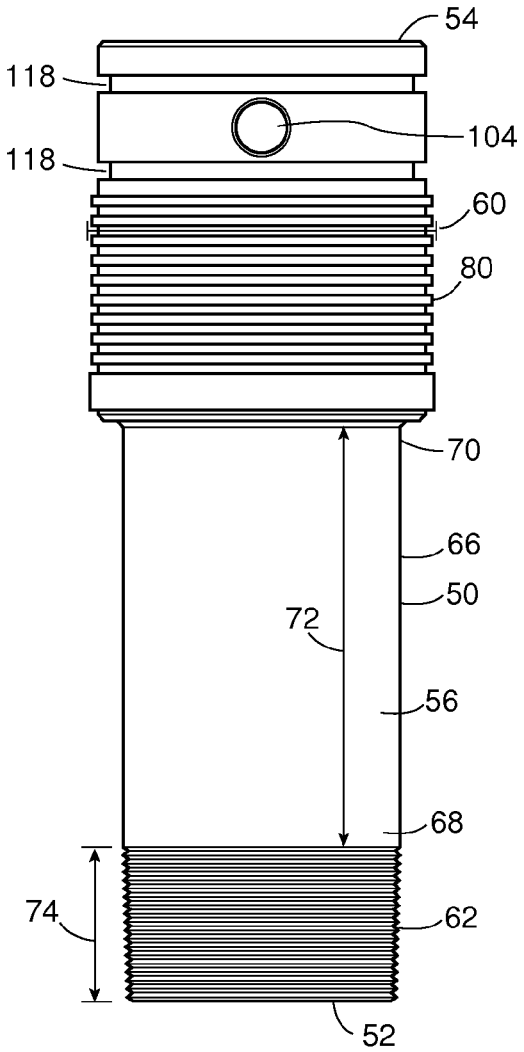
FIG. 4 is a side view of the tubular mandrel of the tubing hanger show in FIG. 2, in isolation.

Referring particularly to FIGS. 2, 4 and 5, the tubular mandrel (50) comprising the tubing hanger (78) is further comprised of a second mandrel connector (80) located at the second mandrel end (54). In addition, referring to FIGS. 2, 3 and 5, the tubing hanger (78) is comprised of a tubing shell (82).

The tubular shell (82) has a first shell end (84), an opposed second shell end (86) and a longitudinal axis (88) which extends between the first and second shell ends (84, 86). Further, the tubular shell (82) has an external shell surface (90) and defines a shell bore (92) extending longitudinally through the tubular shell (82) between the first and second shell ends (84, 86).

The external shell surface (90) is adapted and/or configured for engagement with the tubing head (not shown) at the surface of the wellbore. For instance, the diameter and shape of the external shell surface (90) of the tubular shell (82) are compatible with the diameter and shape of the bore of the tubing head. Further, the external shell surface (90) defines a tubing head engagement surface (94) which is adapted to engage the bore of the tubing head such that the tubing hanger (78) may support the well tubing (24), and in particular the first well tubing (28), in the wellbore. The tubing head engagement surface (94) is shaped and configured such that the tubing shell (82) may be securely engaged with the tubing head when the tubing shell (82) is received within the bore of the tubing head. Further, the tubing head engagement surface (94) is shaped and configured such that the tubing shell (82) may be readily disengaged from the tubing head when the tubing hanger (78) is required to be removed or the well tubing (24) is otherwise required to be moved within the wellbore.

A shell seal device (96) may be associated with the external shell surface (90) in order to permit the tubular shell (82) to seal with the tubing head when the tubular shell (82) is received and engaged within the tubing head. The shell seal device (96) may be particularly positioned or located between the tubing head engagement surface (94) and the adjacent surface of the bore of the tubing head For instance, as shown in FIGS. 2, 3 and 5, the external shell surface (90), and particularly the tubing head engagement surface (94), may define one or more grooves (98) therein extending about the circumference of the tubular shell (82) Further, one or more sealing elements, such as an O-ring type seal (not shown), may be received within each groove (98) for sealing between the adjacent surfaces of the tubular shell (82) and the tubing head. Thus, the shell seal device (96) may be comprised of the grooves (98) and the sealing elements received therein The shell bore (92) is adapted and configured for receiving the tubular mandrel (50) therein. In particular, the shell bore (92) is adapted and configured for receiving the second mandrel end (54). In this regard, the tubular shell (82) may be comprised of a shell connector (100) for connecting with the second mandrel connector (80) in order to provide a second connection (102) between the tubular mandrel (50) and the tubular shell (82), as shown in FIG. 2.

As stated, the second mandrel connector (80) is located at the second mandrel end (54) and is adapted for connecting with the shell connector (100). In some embodiments, the second mandrel connector (80) is comprised of a pin connector defined by the external mandrel surface (56) at, adjacent or in proximity to the second mandrel end (54). The shell connector (100) is compatible with the second mandrel connector (80) and may be comprised of, or defined by, the shell bore (92) For instance, the shell connector (100) may be defined by a portion of the shell bore (92) adjacent or in proximity to the first shell end (84). Thus, the shell connector (100) may be a box connector defined by the shell bore (92) which is compatible with the pin connector comprising the second mandrel connector (80).

In some embodiments, the second connection (100) is a second threaded connection Thus, the second mandrel connector (80) may be a threaded connector, specifically a threaded pin connector. Similarly, the shell connector (100) may be a threaded connector, specifically a threaded box connector.

When the tubular mandrel (50) is received in the shell bore (92) for connection with the tubular shell (92), the second mandrel connector (80) is engaged with the shell connector (100) to provide the second connection (102) When connected in this manner, the first mandrel end (52) and the tong gripping surface (66) of the tubular mandrel (50) extend from the first shell end (84).

Further, as indicated, the second connection (102) may be a threaded second connection. Similarly, the first connection (64) may be a threaded first connection. In such embodiments, in order to permit the shell connector (100) to be threaded with the second mandrel connector (80) to provide the second connection (102), while maintaining the first threaded connection (64), the first threaded connection (64) and the second threaded connection (102) may be threaded in opposite directions. For instance, the shell connector (100) within the shell bore (92) of the tubular shell (82) may provide a left-handed thread, thus providing a second threaded connection (102) threaded in a left handed direction. The first threaded connection (64) of the tubing hanger (78) is threaded in the opposite direction.

In addition, the tubular mandrel (50) and the tubular shell (82) may be maintained at a desired relative position when connected together by a locking mechanism. For instance, in some embodiments, a recess (104) and a corresponding compatible lug (106) may be associated with the tubular mandrel (50) and the tubular shell (82).

In this instance, the recess (104) may be associated with one of the external mandrel surface (56) and the shell bore (92). As shown in FIG. 2, the recess (104) may be defined by the external mandrel surface (56) of the tubular mandrel (50). The recess (104) may be located on either side longitudinally of the second mandrel connector (80). However, in some embodiments, such as that shown in FIG. 2, the recess (104) is positioned between the second mandrel connector (80) and the second mandrel end (54).

Accordingly, the lug (106) is associated with the other of the tubular mandrel (50) and the tubular shell (82). As shown in FIG. 2, the lug (106) may be associated with the tubular shell (82) in a manner such that the lug (106) is movable into engagement with the recess (104) defined by the tubular mandrel (50) when the tubular mandrel (50) and the tubular shell (82) are connected with each other at the desired relative position to provide the second connection (102). The engagement of the lug (106) within the recess (104) prevents or inhibits relative rotation between the tubular mandrel (50) and the tubular shell (82).

Due to the engagement between the recess (104) and the lug (106), the shell connector (100) of the tubular shell (82) is only required to be manually connected with, and hand-tightened to, the second mandrel connector (82) of the tubular mandrel (50) of the tubing hanger (78). Upon hand-tightening the tubular shell (82) manually onto the tubular mandrel (50), the lug (106) is aligned with the recess (104) such that the lug (106) may be engaged with the recess (104).

The lug (106) may be associated with the tubular shell (82) in any manner permitting the movement of the lug (106) into and out of engagement with the recess (104). In some embodiments, the tubular shell (82) defines a passage (108) extending radially through the tubular shell (82) from the external shell surface (90) to the shell bore (92). The passage (108) is adapted for receiving the lug (106) therein such that the lug (106) may extend from the shell bore (92) for engagement with the recess (104), while also permitting access to the lug (106) from the external shell surface (90).

For instance, the lug (106) may be a set screw (110) having an inner end (112) for receipt within and engagement with the recess (104), and having an opposed outer end (114) adapted to permit the set screw (110) to be actuated and moved within the passage (108), such as by engagement with a compatible tool. Further, the passage (108) may be threaded for threadably receiving the set screw (110) therein. Thus, the outer end (114) of the set screw (110) may be engaged to cause the set screw (110) to rotate within the threaded passage (108). Rotation of the set screw (110) in a first direction causes the set screw (110) to move towards the tubular mandrel (50) such that the inner end (112) of the set screw (110) is received within the recess (104). Rotation of the set screw (110) in a second direction, opposed to the first direction, causes the set screw (110) to move away from the tubular mandrel (50) such that the inner end (112) of the set screw (110) is withdrawn from the recess (104).

As discussed above, the recess (104) may be located on either side longitudinally of the second mandrel connector (80). Accordingly, the passage (108), and the set screw (110) are positioned in a corresponding location of the shell bore (92) adjacent the location of the recess (104). However, in some embodiments, such as that shown in FIG. 2, the recess (104) is positioned between the second mandrel connector (80) and the second mandrel end (54). Thus, the passage (108) and the set screw (110) are positioned between the shell connector (100) and the second shell end (86). This positioning of the recess (104) and the passage (106) permits ready or relatively easy access to the set screw (110) in order to move the set screw (110) within the passage (106) into and out of engagement with the recess (104).

For instance, when it is required or desired to remove the tubular shell (82) from the tubular mandrel (50), the tubular shell (82) only needs to be lifted to unseat the tubular shell (82) from the tubing head a sufficient distance to provide access to the set screw (110) through the passage (108). Once the set screw (110) is moved out of engagement with the recess (104), the tubular shell (82) may be rotated relative to the tubular mandrel (50) to remove the tubular shell (82) therefrom. For this reason, in some embodiments, the recess (104) for the set screw (110) is positioned adjacent the second mandrel end (54) such that the tubing hanger (78) is required to be lifted from the tubing head no greater than about 6 inches (15.24 cm) in order to provide access to the set screw (110).

Further, as indicated, the tubular shell (82) is manually rotated to be connected with and disconnected from the second mandrel connector (82) of the tubular mandrel (50) of the tubing hanger (78). In order to assist with the manual rotation of the tubular shell (82), a tightening tool (not shown) may be used which is configured to be compatible for use with the tubular shell (82). For instance, in some embodiments as shown in FIG. 3, the second shell end (86) defines a pair of tightening recesses (115) for engagement with the tightening tool. Specifically, the tightening recesses (115) may be oriented longitudinally in the direction of the longitudinal axis (88) of the tubular shell (82), or be positioned on the uppermost surface of the tubular shell (82) at the second shell end (86). This positioning permits relatively easy access to the tightening recesses (115) by the tightening tool. In addition, the pair of tightening recesses (115) may be positioned on opposed sides of the shell bore (92) of the tubular shell (82).

The tightening tool is adapted and configured to be compatible for engagement with the tubular shell (82), and in particular, for engagement with the tightening recesses (115) such that movement or actuation of the tightening tool causes a corresponding rotation of the tubular shell (82). In some embodiments, the tightening tool is comprised of a tightening wrench (not shown). The tightening wrench may be Y-shaped, having a base and a pair of prongs or arms connected thereto. The base of the tightening wrench is adapted to be gripped by hand for use of the tightening wrench. Each of the prongs may include a tightening pin for receipt within one of the corresponding tightening recesses (115) on the tubular shell (82). Thus, the pair of tightening pins of the tightening wrench are receivable within the pair of tightening recesses (115) defined by the tubular shell (82). Upon engagement of the tightening pins within the tightening recesses (115), the base of the tightening wrench may be gripped by hand and moved to cause the tubular shell (82) to rotate. Accordingly, the tightening wrench is shaped or configured to be compatible with its placement on and engagement with the tubular shell (82).

Further, a mandrel seal device (116) may be associated with at least one of the external mandrel surface (56) and the shell bore (92) in order to permit the tubular mandrel (50) to seal with the tubular shell (82) when the tubular mandrel (50) is received and engaged within the tubular shell (82) to provide the second connection (102). For instance, as shown in FIG. 2, the external mandrel surface (56) may define one or more grooves (118) therein extending about the circumference of the tubular mandrel (50). The one or more grooves (118) are positioned on the external mandrel surface (56) at a location received within the shell bore (92) when the tubular mandrel (50) and the tubular shell (82) are connected together.

In some embodiments, the one or more grooves (118) are defined by the external mandrel surface (56) at a location between the second mandrel connector (80) and the second mandrel end (54). Further, one groove (118) may be particularly located longitudinally on either side of the recess (104). In addition, one or more sealing elements, such as an O-ring type seal (not shown), may be received within each groove (118) for sealing between the adjacent surfaces of the tubular mandrel (50) and the tubular shell (82). Thus, the mandrel seal device (116) may be comprised of the grooves (166) and the sealing elements received therein.

During use of the tubing hanger (78), it may be necessary to lift the tubing hanger (78) and/or the first well tubing (28) connected thereto. Thus, in the tubing hanger (78), the tubular mandrel (50) may be further comprised of a third mandrel connector (120) located at the second mandrel end (54) which is adapted for connecting the tubular mandrel (50) with a lifting member (122), as shown in FIG. 5, in order to provide a third connection (124) between the tubular mandrel (50) and the lifting member (122).

As stated, the third mandrel connector (120) is located at the second mandrel end (54) and is adapted for connecting with the lifting member (122). In some embodiments, the third mandrel connector (120) is a threaded connector and may be defined by the mandrel bore (58) at, adjacent or in proximity to the second mandrel end (54). The lifting member (122) is compatible with the third mandrel connector (120) and may also be comprised of a threaded lifting member connector (126).

Figure 2A:
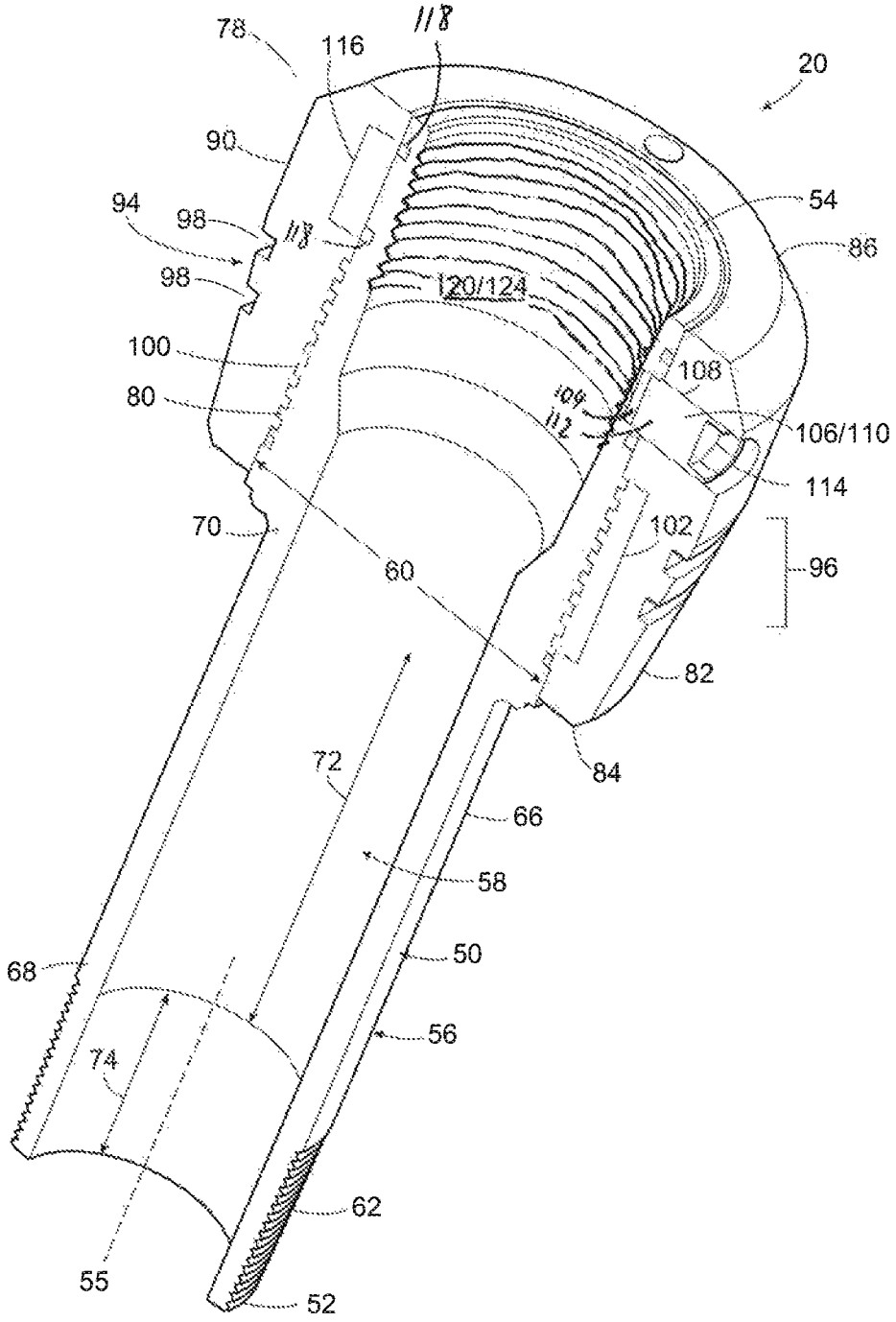
FIG. 2A is a similar view to FIG. 2, wherein the third mandrel connector is shown as an external upset end (EUE) box connector.

For instance, in some embodiments, the third mandrel connector (120) may be a threaded box connector, while the lifting member connector (126) may be a threaded pin connector. The third mandrel connector (120) may be comprised of a EUE box connector (FIG. 2A). Accordingly, in such embodiments, the engagement of the third mandrel connector (120) with the lifting member connector (126) provides the third connection (124). Further, the first threaded connection (64) and the third threaded connection (124) of the tubing hanger (78) may be threaded in the same direction so that threading of the lifting member connector (126) into engagement with the third mandrel connector (120) tends to tighten or maintain the first threaded connection (64).

As a result of the configuration of the tubing hanger (78) as described above, the tubing shell (82) may be more readily removable in circumstances in which the tubing string in the wellbore becomes sanded in or otherwise stuck within the wellbore. Specifically, the tubing string, including the first well tubing (20), is connected with the tubular mandrel (50) of the tubing hanger (78). Further, the tubing hanger (78) is supported within the tubing head at the well surface such that the tubing string connected therewith is supported within the wellbore.

If stuck within the wellbore, the tubing string is typically capable of stretching or elongating sufficiently to permit the tubing hanger (78) to be unseated from the tubing head and raised a lifting distance of about 6 inches (15.24 cm) or no greater than about 6 inches (15.24 cm). This lifting distance is sufficient to permit the removal of the tubular shell (82)

from the tubular mandrel (50). Specifically, the lifting distance is sufficient to expose the passage (108) in the tubular shell (82) to provide access to the set screw (110). Once the set screw (110) is disengaged from the recess (104), the tubular shell (82) may be manually rotated in order to remove the tubular shell (82) from the tubular mandrel (50). For this purpose, the tightening wrench, as described above, may be used. The positioning of the tightening recesses (115) on the tubular shell (82) provides relatively easy access by the tightening wrench such that the tubular shell (82) may be rotated without requiring further lifting of the tubing hanger (78) or removal of the tubular shell (82) from the tubing head.

Once the tubular shell (82) is removed, the tubular mandrel (50) and the tubing string connected thereto may be reciprocated within the wellbore in order to release the tubing string. In addition, once the tubular shell (82) is removed, a blowout preventer ("BOP") may be mounted with the tubing head. Thus, the BOP may be in place for safety purposes while reciprocating the tubing string within the wellbore. As well, once the tubular shell (82) is removed, small diameter coiled tubing, such as coiled tubing having a diameter of about 1 inch (2.54 cm), may be run into the wellbore within the annulus between the tubular mandrel (50) and well tubing (24) and the wall of the wellbore. The coiled tubing may be ran to the sanded area within the wellbore and utilized to flush the wellbore.

Further, as a result of the configuration of the tubing hanger (78) as described above, a BOP may be mounted in place while the tubing hanger (78) is seated with the tubing head, and the tubing hanger (78) may be removed by lifting the tubing head (78) through the BOP. In this regard, once the tubular shell (82) is removed, the BOP may be closed around the tubular mandrel (50). In addition, the configuration of the tubing hanger (78) permits the tubing string to be more readily placed in tension through use of the lifting member (122) and the minimal lifting of the tubing hanger (78) required to connect and disconnect the tubular shell (82).

In some further exemplary embodiments of the well tool (20), the well tool (20) is a tubing drain (128), as shown in FIGS. 6-10. The tubing drain (128) is typically provided to permit fluid to be drained from a tubing string comprised of one or more lengths of the well tubing (24) supported within the wellbore. Thus, the tubing drain (128) is often connected within or along the tubing string, between lengths of the well tubing (24) comprising the tubing string. For instance, as shown in FIG. 9, the tubing drain (128) may be connected between a first well tubing (28) and a second well tubing (30). In this case, the tubing drain (128) is adapted to be connected with and disconnected from each of the first well tubing (28) and the second well tubing (30) using the power tong device (22) of the type shown in FIG. 1.

In this regard, the first connection (64) between the first mandrel connector (62) of the tubular mandrel (50) comprising the tubing drain (128) and the first well tubing (28) has been described previously.

Further, referring particularly to FIGS. 6 and 8-10, the tubular mandrel (50) comprising the tubing drain (128) is further comprised of a second mandrel connector (130) located at the second mandrel end (54). In addition, referring to FIGS. 6, 7, 9 and 10, the tubing drain (128) is further comprised of an actuatable drain closing device (132).

The second mandrel connector (130) located at the second mandrel end (54) of the tubular mandrel (50) comprising the tubing drain (128) is adapted for connecting the tubular mandrel (50) with the second well tubing (30), as shown in FIG. 9, in order to provide a second connection (134) between the tubular mandrel (50) and the second well tubing (30). In some embodiments, the second mandrel connector (130) is comprised of a pin connector defined by the external mandrel surface (56) at the second mandrel end (54). Further, in some embodiments, the second connection (134) of the tubing drain (128) is a second threaded connection. Thus, the second mandrel connector (130) may be a threaded connector, specifically a threaded pin connector. In particular, the second mandrel connector (130) may be comprised of an EUE pin connector.

The second well tubing (30) has a connector (26) compatible with the second mandrel connector (130) to provide the second connection (134). Thus, for instance, the connector (26) of the second well tubing (30) may be a compatible box connector, and in particular, a threaded box connector. However, in some embodiments, as shown in FIG. 9, the connector (26) of the second well tubing (30) is comprised of a pin connector. Thus, in order to provide the required connection therebetween, the second connection (134) may further include a compatible or complementary threaded box end coupler (32). Accordingly, in such embodiments, the second mandrel connector (130), the connector (26) of the second well tubing (30) and the coupler (32) may together provide the second connection (134).

Typically, based on 3.5 inch size well tubing, the length of the connector (26) on the second well tubing (30) may be between about 2.5 inches (about 6.35 cm) and about 3 inches (about 7.62 cm). Similarly, in some embodiments, the length of the second mandrel connector (130) may be between about 2.5 inches (about 6.35 cm) and about 3 inches (about 7.62 cm). Thus, once connected by the coupler (32), the second connection (134) may be between about 5 inches (about 12.7 cm) and about 6 inches (about 15.24 cm) in length. If desired or required to enhance the second connection (134), a torque ring (not shown) or other mechanism for facilitating the connection may be positioned between the second mandrel connector (130) and the connector (26) on the second well tubing (30).

As discussed previously, the external mandrel surface (56) defines the tong gripping surface (66) located between the first mandrel end (52) and the second mandrel end (54) of the tubular mandrel (50). The tong gripping surface (66) is provided for contact with one of the powered tong (34) and the back-up tong (36) when connecting or disconnecting the well tool (20), and in this instance the tubing drain (128), using the power tong device (22).

Accordingly, with reference to the tubing drain (128), the tubular mandrel (50) is configured so that when the tong gripping surface (66) and the first well tubing (28) are gripped by the power tong device (22) in order to connect the tubular mandrel (50) of the tubing drain (128) with the first well tubing (28), the first connection (64) is located within the gripping span (40) of the power tong device (22). Specifically, in this embodiment, the powered tong (34) grips the tong gripping surface (66) on the tubular mandrel (50), while the back-up tong (36) grips the first well tubing (28). The first connection (64) provided by the engagement of the first mandrel connector (62), the connector (26) of the first well tubing (28) and the coupler (32) is located within the gripping span (40).

Furthermore, with reference to the tubing drain (128), the tubular mandrel (50) is also configured so that when the tong gripping surface (66) and the second well tubing (30) are gripped by the power tong device (22) in order to connect the tubular mandrel (50) of the tubing drain (128) with the second well tubing (30), the second connection (134) is located within the gripping span (40) of the power tong device (22). Specifically, in this embodiment, the powered tong (34) grips the second well tubing (30), while the back-up tong (36) grips the tong gripping surface (66) on the tubular mandrel (50). The second connection (134) provided by the engagement of the second mandrel connector (130), the connector (26) of the second well tubing (30) and the coupler (32) is located within the gripping span (40).

The tubular mandrel (50) comprising the tubing drain (128) also defines a drain (136) extending axially or radially between the external mandrel surface (56) and the mandrel bore (58) to provide a passage or channel permitting the flow of fluids out of the tubular mandrel (50) or the draining of any fluids contained within the tubing drain (128). The drain (136) is positioned longitudinally along the tubular mandrel (50) between the first and second mandrel ends (52, 54) at a position such that it does not interfere or coincide with the tong gripping surface (66). In some embodiments, as shown in FIGS. 6 and 8-10, the drain (136) is positioned between the tong gripping surface (66) and the first mandrel end (52). More particularly, the drain (136) may be positioned between the first gripping surface end (68) of the tong gripping surface (66) and the first mandrel connector (62).

Figure 10:
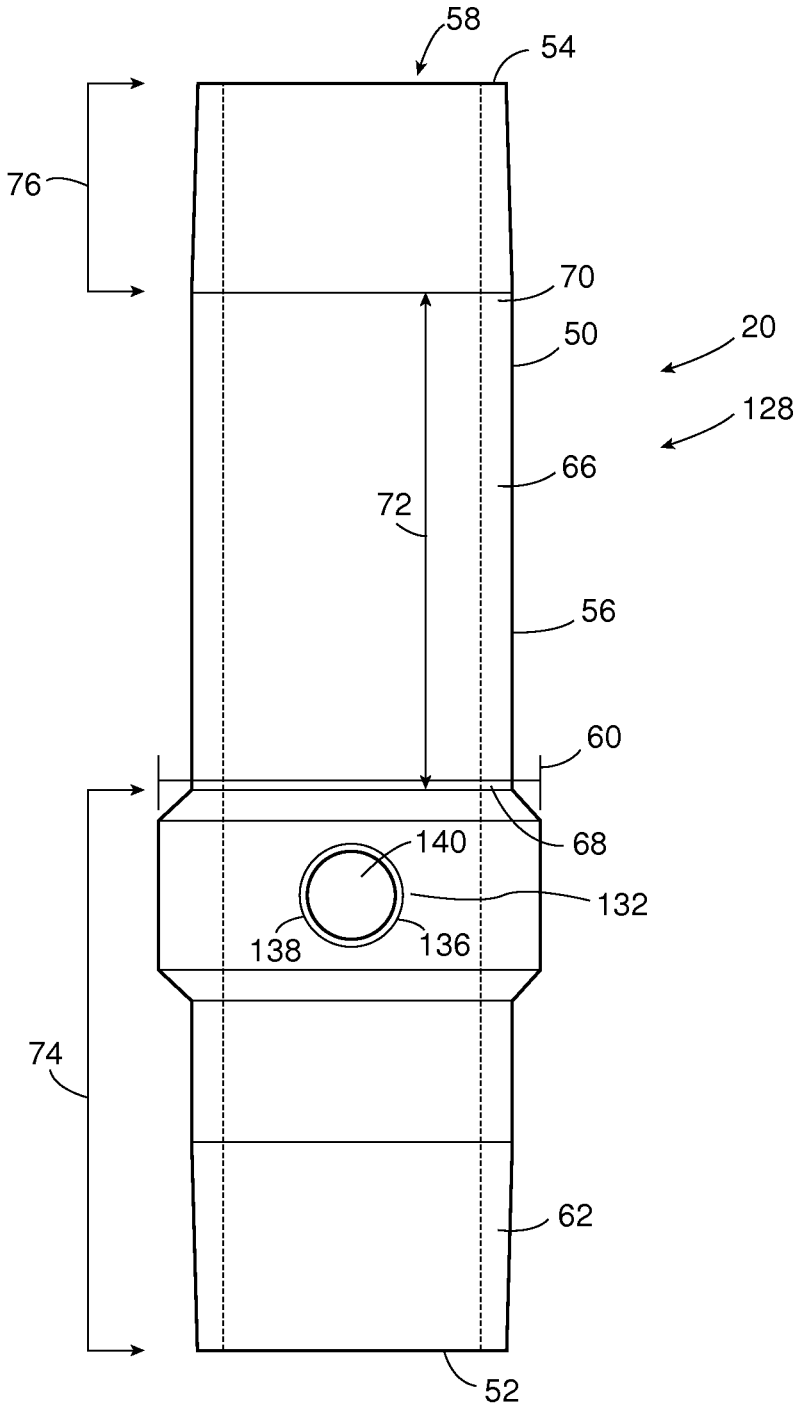
FIG. 10 is a side view of an embodiment of a well tool adapted to be connected and disconnected from a well tubing using a power tong device of the type shown in FIG. 1, wherein the well tool is a tubing drain, wherein the well tool is comprised of a tubular mandrel and an actuatable drain closing device and wherein the drain closing device is comprised of a burst plug.

In one exemplary embodiment, shown in FIG. 10, the drain (136) is comprised of a single drain port (138). In other exemplary embodiments, shown in FIGS. 6-9, the drain (136) is comprised of a plurality of drain ports (138) circumferentially spaced about or around the tubular mandrel (50). In each instance, the actuatable drain closing device (132) is arranged to close the drain (136). Furthermore, the drain closing device (132) is actuatable to open the drain (136) such that fluid may be selectively drained or removed from the tubing drain (128). Thus, the drain closing device (132) is arranged to close the one or more drain ports (138) to prevent or inhibit the passage of fluids through the drain port (138). However, upon actuation of the drain closing device (132), the drain (136) is opened to permit the flow of fluid through the drain ports (138).

The drain closing device (132) may be actuatable to open the drain (136) by providing an actuating pressure in the mandrel bore (58) of the tubular mandrel (50) of the tubing drain (128). More particularly, fluid may be conducted to the tubing drain (128) from the surface through the tubing string to the second well tubing (30) connected with the tubular mandrel (50) of the tubing drain (128). Upon pressurizing the fluid in the tubular mandrel (50) to the actuating pressure, the drain (136) will be caused to open.

Referring to FIG. 10, in one exemplary embodiment of the tubing drain (128), the drain (136) is comprised of a single drain port (138). The dimensions of the drain port (138) are selected to provide the desired drainage area from the mandrel bore (58) to achieve a desired flow of fluid through the drain port (138) when open. In this embodiment, the drain closing device (132) may be comprised of a burst plug (140). Accordingly, when the actuating pressure is provided in the mandrel bore (58), the burst plug (140) is caused to rupture in order to open the drain (136) and thereby permit fluid to pass through the drain port (138).

Figure 7:
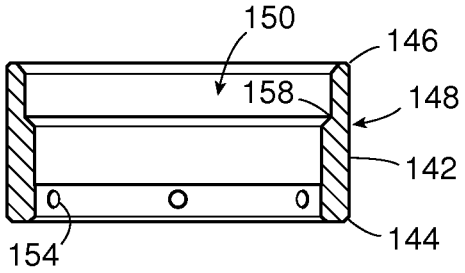
FIG. 7 is a longitudinal sectional view of the slidable sleeve of the tubing drain shown in FIG. 6, in isolation.
Figure 8:
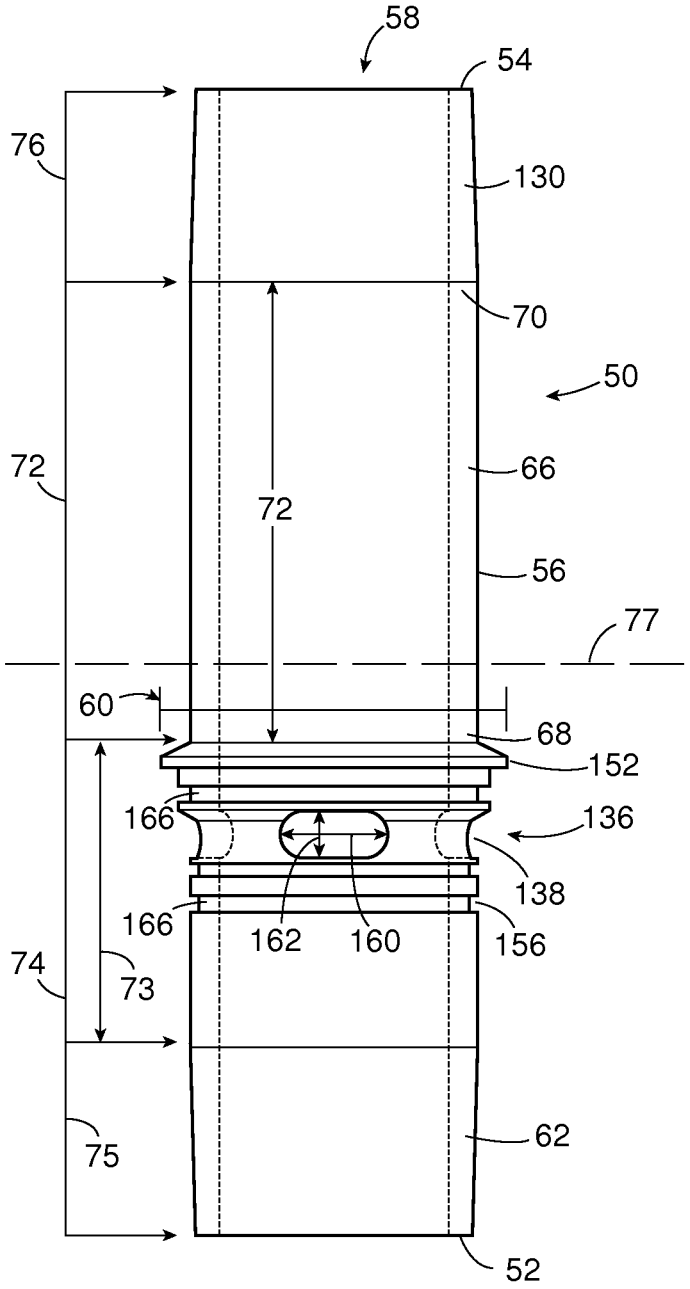
FIG. 8 is a side view of the tubular mandrel of the tubing drain shown in FIG. 6, in isolation.

Referring to FIGS. 6, 7 and 9, in some other exemplary embodiments of the tubing drain (128), the drain (136) is comprised of a plurality of drain ports (138). In this embodiment, the drain ports (138) may be spaced circumferentially around the tubular mandrel (50). For instance, as shown in FIGS. 6 and 8, the drain (136) may include four drain ports (138) equidistantly spaced about the circumference of the tubular mandrel (50). However, any alternate number of drain ports (138) and spacing may be provided.

In this embodiment, the drain closing device (132) may be comprised of a slidable sleeve (142) surrounding the tubular mandrel (50) such that the slidable sleeve (142) covers the drain ports (138) in order to close the drain (136). More particularly, the slidable sleeve (142) has a first sleeve end (144), an opposed second sleeve end (146) and an external sleeve surface (148). Further, the slidable sleeve (142) defines a sleeve bore (150) extending therethrough between the first and second sleeve ends (144, 146). The slidable sleeve (142) is positioned about the tubular mandrel (50) such that the external mandrel surface (56) defining the drain ports (138) is closely received within the sleeve bore (150).

In some embodiments of the tubing drain (128), the external mandrel surface (56) defines an external mandrel shoulder (152). In this instance, the external mandrel shoulder (152) defines the maximum mandrel diameter (60). Thus, the slidable sleeve (142) is configured such that the maximum diameter of the slidable sleeve (142) is no greater than the maximum mandrel diameter (60). The external mandrel shoulder (152) assists or facilitates the desired placement of the slidable sleeve (142) on the tubular mandrel (50). Further, the external mandrel shoulder (152) is positioned between the drain (136) and the tong gripping surface (66). More particularly, the external mandrel shoulder (152) is positioned adjacent the first gripping surface end (68).

Thus, when the drain (136) is closed, the second sleeve end (146) of the slidable sleeve (142) is positioned against or in abutment with the external mandrel shoulder (152). The diameter of the external mandrel shoulder (152) and the diameter of the slidable sleeve (142) are compatible, as discussed above, such that the external mandrel shoulder (152) provides some protection to the slidable sleeve (142) and also prevents further movement of slidable sleeve (142) in the direction of the tong gripping surface (66) past the external mandrel shoulder (152). In addition, in order to maintain the slidable sleeve (142) in the closed drain position, movement of the slidable sleeve (142) in the opposite direction away from the external mandrel shoulder (152) is prevented or inhibited by a locking mechanism, such as one or more shear screws or pins (154).

Specifically, in some embodiments, the slidable sleeve (142) is maintained in abutment against the external mandrel shoulder (152) by a plurality of shear pins (154) extending between the sleeve bore (150) and the external mandrel surface (56). Thus, the slidable sleeve (142) and the tubular mandrel (50) defining the drain (136) may be maintained at a desired longitudinal position relative to each other by a combination of the shear pins (154) and the external mandrel shoulder (152).

For instance, a recess (156) may be associated with one of the external mandrel surface (56) and the sleeve bore (150). As shown in FIG. 6, the recess (156) may be defined by the external mandrel surface (56) of the tubular mandrel (50). Further, the recess (156) may extend circumferentially about the external mandrel surface (56), being located on either side longitudinally of the drain port (138). However, in some embodiments, such as that shown in FIG. 6, the circumferentially extending recess (156) is positioned on the external mandrel surface (56) such that the recess (156) is located adjacent the first sleeve end (144) when the slidable sleeve (142) abuts against the external mandrel shoulder (152). In this instance, the shear pins (154) extend from the slidable sleeve (142) into the sleeve bore (150) for engagement with, and receipt within, the recess (156). The engagement of the shear pins (154) within the recess (156) prevents or inhibits movement of the slidable sleeve (142) relative to the tubular mandrel (50).

Further, the shear pins (154) are selected to shear when the actuating pressure is provided in the mandrel bore (58). Specifically, the sleeve bore (150) defines an internal sleeve shoulder (158) extending circumferentially about the sleeve bore (150). The internal sleeve shoulder (158) is positioned between the first and second sleeve ends (144, 146) at a location such that the internal sleeve shoulder (158) is located adjacent the plurality of drain ports (138) when the slidable sleeve (142) abuts against the external mandrel shoulder (152) and the shear pins (154) are received within the recess (156). Thus, fluid within the mandrel bore (58) may communicate with the internal sleeve shoulder (158) through the drain ports (138).

As a result, when the actuating pressure is provided in the mandrel bore (58), the actuating pressure acts upon the internal sleeve shoulder (158) causing the shear pins (154) to shear and the slidable sleeve (142) to move relative to the tubular mandrel (50) in the direction of the first mandrel end (52), thereby uncovering the drain ports (138) and opening the drain (136). In order to permit the movement of the slidable sleeve (142), a sufficient distance or longitudinal length of the tubular mandrel (50) is provided between the drain (136) and the first mandrel connector (62) to accommodate the slidable sleeve (142). Specifically, in some embodiments, the length of the slidable sleeve (142) between the first and second sleeve ends (144, 146) is between about 1.7 inches (4.32 cm) to 2.3 inches (5.84 cm), or about 2 inches (5.08 cm).

In addition, the number of drain ports (138) and the configuration of each of the drain ports (138) is selected to provide the desired drainage area from the mandrel bore (58) to permit the flow of fluids therethrough. Further, the configuration of the drain ports (138) is also dependent upon the dimensions of the slidable sleeve (142) and the desire to provide a configuration of the tubing drain (128) able to be connected and disconnected from well tubing using a power tong device (22).

For instance, referring to FIG. 8, in some embodiments, each of the plurality of drain ports (138) has a major dimension (160) and a minor dimension (162), wherein the major dimension (160) is larger than the minor dimension (162). In other words, each of the drain ports (138) may be oval or elliptical in shape. For instance, in an embodiment including four drain ports (138), the major dimension (160) of each of the drains ports (138) may be about 1.4 inches (3.556 cm), while the minor dimension (162) of each of the drain ports (138) may be about 0.6 inches (1.524 cm).

Furthermore, each of the plurality of drain ports (138) is arranged so that the minor dimension (162) extends in a direction which is parallel with the longitudinal axis of the tubing drain (128), being defined by the longitudinal axis (55) of the tubular mandrel (50). Thus, each of the plurality of drain ports (138) may also be arranged so that the major dimension (160) extends in a direction which is perpendicular with the longitudinal axis (55) of the tubular mandrel (50).

This arrangement of the drain ports (138) allows for a reduction in the length of the slidable sleeve (142), defined by the distance between the first and second sleeve ends (144, 146), required to cover the drain ports (138) and thereby close the drain (136). Further, this arrangement allows for a resulting reduction in the first span length (74) between the first gripping surface end (68) and the first mandrel end (52). As discussed previously, in some embodiments, the first span length (74) is no greater than about 8 inches (20.32 cm) in order to permit the tubing drain (128) to be connected with and disconnected from the first well tubing (28) using the power tong device (22) as discussed above. Finally, in this embodiment, as a result of the arrangement of the drain ports (138), each of the length of the slidable sleeve (142) and the first span length (74) may be reduced, while maintaining the desired drainage area from the mandrel bore (58).

A sleeve seal device (164) may be provided in some embodiments for providing a seal between the tubular mandrel (50) and the slidable sleeve (142). In particular, the sleeve seal device (164) may be associated with at least one of the external mandrel surface (56) and the sleeve bore (150) in order to permit the tubular mandrel (50) to seal with the slidable sleeve (142) when the slidable sleeve (142) is in the "closed position" being held in abutment against the external mandrel shoulder (152) by the shear pins (154).

For instance, as shown in FIG. 6, the external mandrel surface (56) may define one or more grooves (166) therein extending about the circumference of the tubular mandrel (50). The one or more grooves (166) are positioned on the external mandrel surface (56) at a location received within the sleeve bore (150) when the slidable sleeve (142) is in the closed position. In some embodiments, one groove (166) is located longitudinally on either side of the drain ports (138). In addition, one or more sealing elements, such as an O-ring type seal (not shown), may be received within each groove (166) for sealing between the adjacent surfaces of the tubular mandrel (50) and the slidable sleeve (142). Thus, the sleeve seal device (164) may be comprised of the grooves (166) and the sealing elements received therein.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

We claim:

1. A tubing hanger adapted to be connected with and disconnected from a well tubing using a power tong device having a pair of tongs, a gripping span between the pair of tongs, and a maximum clearance diameter for an object passing through the tongs, the tubing hanger comprising:

a tubular mandrel having a first mandrel end, a second mandrel end, an external mandrel surface, a maximum mandrel diameter less than said maximum clearance diameter, and defining a mandrel bore, wherein the tubular mandrel comprises a first mandrel connector and a second mandrel connector, the first mandrel connector located at the first mandrel end which is adapted for connecting the tubular mandrel with a well tubing in order to provide a first connection between the tubular mandrel and the well tubing, wherein the external mandrel surface defines a tong gripping surface having a gripping surface length and the tong gripping surface is located between the first mandrel end and the second mandrel end, wherein the tubular mandrel is configured so that when the tong gripping surface and the well tubing are gripped by the power tong device in order to connect the tubular mandrel with the well tubing the first connection is located within the gripping span, wherein the tong gripping surface is clear of external and internal treading along the length of the tong gripping surface;

a tubular shell having a first shell end, a second shell end, and defining a shell bore for receiving the tubular mandrel therein, wherein the tubular shell has an external shell surface, wherein the external shell surface defines a tubing head engagement surface which is adapted to engage a tubing head, wherein the tubular shell comprises a shell connector for connecting with the second mandrel connector in order to provide a second connection between the tubular mandrel and the tubular shell, and wherein the first mandrel end and the tong gripping surface extend from the first shell end when the tubular mandrel is received in the shell bore and the tubular mandrel is connected with the tubular shell; and a recess associated with the tubular mandrel and a lug associated with the tubular shell, wherein the lug is movable into engagement with the recess when the tubular mandrel and the tubular shell are connected with each other at a desired relative position in order to maintain the tubular mandrel and the tubular shell at the desired relative position.

2. The tubing hanger as claimed in claim 1, wherein the lug comprises a set screw threadably associated with the tubular shell, and wherein the set screw is movable into engagement with the recess in order to maintain the tubular mandrel and the tubular shell at the desired relative position.

3. The tubing hanger as claimed in claim 1, wherein the first mandrel connector is a threaded connector so that the first connection is a first threaded connection, wherein the second connection is a second threaded connection, and wherein the first threaded connection and the second threaded connection are threaded in opposite directions.

4. The tubing hanger as claimed in claim 1, wherein each of the tongs in the pair of tongs has a tong length, and wherein the gripping surface length is greater than the tong length.

5. The tubing hanger as claimed in claim 1, further comprising a shell seal device associated with the external shell surface, for providing a seal between the tubular shell and the tubing head.

6. The tubing hanger as claimed in claim 5, further comprising a mandrel seal device associated with at least one of the external mandrel surface and the shell bore, for providing a seal between the tubular mandrel and the tubular shell.

7. The tubing hanger as claimed in claim 1, wherein the first mandrel connector comprises a threaded connector.

8. The tubing hanger as claimed in claim 7, wherein the first mandrel connector comprises an external upset end (EUE) pin connector.

9. The tubing hanger as claimed in claim 7, wherein the second connection comprises a second threaded connection.

10. The tubing hanger as claimed in claim 9, wherein the second mandrel connector comprises a pin connector defined by the external mandrel surface and wherein the shell connector comprises a box connector defined by the shell bore.

11. The tubing hanger as claimed in claim 1, wherein the tubular mandrel is further comprised of a third mandrel connector located at the second mandrel end which is adapted for connecting the tubular mandrel with a lifting member in order to connect the tubular mandrel and the lifting member.

12. The tubing hanger as claimed in claim 11, wherein the third mandrel connector comprises a threaded connector.

13. The tubing hanger as claimed in claim 12, wherein the third mandrel connector comprises an external upset end (EUE) box connector.

14. The tubing hanger as claimed in claim 1, wherein the maximum clearance diameter is 6 inches and the maximum mandrel diameter is less than 6 inches.

15. The tubing hanger as claimed in claim 1, wherein the maximum clearance diameter is 5 inches and the maximum mandrel diameter is less than 5 inches.

16. The tubing hanger as claimed in claim 1, wherein the gripping span is 11 inches.

17. The tubing hanger as claimed in claim 1, wherein the tong gripping surface has a first gripping surface end and a second gripping surface end, wherein the first gripping surface end is between the first mandrel end and the second gripping surface end, wherein the tubular mandrel has a first span length between the first gripping surface end and the first mandrel end, and wherein the first span length is no greater than 8 inches.

18. The tubing hanger as claimed in claim 1, in which the gripping surface length is 6 inches.

19. A tubing hanger adapted to be connected with and disconnected from a well tubing using a power tong device having a pair of tongs, a gripping span between the pair of tongs, and a maximum clearance diameter for an object passing through the tongs, the tubing hanger comprising:

a tubular mandrel having a first connector end, a second connector end, an external mandrel surface, a maximum mandrel diameter less than said maximum clearance diameter, and defining a mandrel bore, wherein the tubular mandrel comprises a first mandrel connector located at the first mandrel end which is adapted for connecting the tubular mandrel with a well tubing in order to provide a first connection between the tubular mandrel and the well tubing, wherein the external mandrel surface defines a tong gripping surface located between the first mandrel end and the second mandrel end, wherein the tubular mandrel is configured so that when the tong gripping surface and the well tubing are gripped by the power tong device in order to connect the tubular mandrel with the well tubing the first connection is located within the gripping span, and wherein the tubular mandrel has a second mandrel connector;

a tubular shell having a first shell end, a second shell end, and defining a shell bore extending through said tubular shell between said first shell end and said second shell end, said shell bore being sized and shaped to receive said first connector end of said tubular mandrel within said bore, wherein the tubular shell has an external shell surface, wherein the external shell surface defines a tubing head engagement surface which is adapted to engage a tubing head, wherein the tubular shell comprises a shell connector for connecting with the second mandrel connector in order to provide a second connection between the tubular mandrel and the tubular shell, and wherein the first mandrel end and the tong gripping surface extend from the first shell end when the tubular mandrel is received in the shell bore and the tubular mandrel is connected with the tubular shell; and a recess positioned in the tubular mandrel and and a movable lug positioned in, and movable relative to, the tubular shell, wherein the lug is movable into engagement with the recess when the tubular mandrel and the tubular shell are connected with each other at a desired relative position in order to maintain the tubular mandrel and the tubular shell at the desired relative position.

20. The tubing hanger as claimed in claim 19, wherein the lug comprises a set screw threadably associated with the tubular shell, and wherein the set screw is movable into engagement with the recess in order to maintain the tubular mandrel and the tubular shell at the desired relative position.

21. The tubing hanger as claimed in claim 19, wherein the first mandrel connector is a threaded connector so that the first connection is a first threaded connection, wherein the second connection is a second threaded connection, and wherein the first threaded connection and the second threaded connection are threaded in opposite directions.

22. The tubing hanger as claimed in claim 19, wherein each of the tongs in the pair of tongs has a tong length, wherein the tong gripping surface has a gripping suffice length, and wherein the gripping surface length is greater than the tong length.

23. The tubing hanger as claimed in claim 19, further comprising a shell seal device associated with the external shell surface, for providing a seal between the tubular shell and the tubing head.

24. The tubing hanger as claimed in claim 23, further comprising a mandrel seal device associated with at least one of the external mandrel surface and the shell bore, for providing a seal between the tubular mandrel and the tubular shell.

25. The tubing hanger as claimed in claim 19, wherein the first mandrel connector comprises a threaded connector.

26. The tubing hanger as claimed in claim 25, wherein the first mandrel connector comprises an external upset end (EUE) pin connector.

27. The tubing hanger as claimed claim 25, wherein the second connection comprises a second threaded connection.

28. The tubing hanger as claimed in claim 27, wherein the second mandrel connector comprises a pin connector defined by the external mandrel surface and wherein the shell connector comprises a box connector defined by the shell bore.

29. The tubing hanger as claimed in claim 19, wherein the tubular mandrel is further comprised of a third mandrel connector located at the second mandrel end which is adapted for connecting the tubular mandrel with a lifting member in order to provide a third connection between the tubular mandrel and the lifting member.

30. The tubing hanger as claimed in claim 29, wherein the third mandrel connector comprises a threaded connector.

31. The tubing hanger as claimed in claim 30, wherein the third mandrel connector comprises an external upset end (EUE) box connector.

32. The tubing hanger as claimed in claim 19, wherein the maximum clearance diameter is 6 inches and the maximum mandrel diameter is less than 6 inches.

33. The tubing hanger as claimed in claim 32, wherein the maximum clearance diameter is 5 inches and the maximum mandrel diameter is less than 5 inches.

34. The tubing hanger as claimed in claim 19, wherein the gripping span is 11 inches.

35. The tubing hanger as claimed in claim 19, wherein the tong gripping surface has a gripping surface length, and the gripping surface length is greater than 4 inches and no greater than 15 inches.

36. The tubing hanger as claimed in claim 35, wherein the gripping surface length is 6 inches.

37. The tubing hanger as claimed in claim 19, wherein the tong gripping surface has a first gripping surface end and a second gripping surface end, wherein the first gripping surface end is between the first mandrel end and the second gripping surface end, wherein the tubular mandrel has a first span length between the first gripping surface end and the first mandrel end, and wherein the first span length is no greater than 8 inches.

38. A tubing hanger adapted to be connected with and disconnected from a well tubing using a power tong device having a pair of tongs, a gripping span between the pair of tongs, and a maximum clearance diameter for an object passing through the tongs, the tubing hanger comprising:

a tubular mandrel having a first mandrel end, a second mandrel end, an external mandrel surface, a maximum mandrel diameter less than said maximum clearance diameter, and defining a mandrel bore, wherein the tubular mandrel comprises a first mandrel connector and a second mandrel connector, the first mandrel connector located at the first mandrel end which is adapted for connecting the tubular mandrel with a well tubing in order to provide a first connection between the tubular mandrel and the well tubing, wherein the external mandrel surface defines a tong gripping surface located between the first mandrel end and the second mandrel end, wherein the tubular mandrel is configured so that when the tong gripping surface and the well tubing are gripped by the power tong device in order to connect the tubular mandrel with the well tubing the first connection is located within the gripping span, wherein the tong gripping surface includes at least a portion which extends towards the other of said connector ends across a midpoint between said mandrel ends;

a tubular shell having a first shell end, a second shell end, and defining a shell bore for receiving the tubular mandrel therein, wherein the tubular shell has an external shell surface, wherein the external shell surface defines a tubing head engagement surface which is adapted to engage a tubing head, wherein the tubular shell comprises a shell connector for connecting with the second mandrel connector in order to provide a second connection between the tubular mandrel and the tubular shell, and wherein the first mandrel end and the tong gripping surface extend from the first shell end when the tubular mandrel is received in the shell bore and the tubular mandrel is connected with the tubular shell; and a recess associated with the tubular mandrel and a lug associated with the tubular shell, wherein the lug is movable into engagement with the recess when the tubular mandrel and the tubular shell are connected with each other at a desired relative position in order to maintain the tubular mandrel and the tubular shell at the desired relative position.

39. The tubing hanger as claimed in claim 38, wherein the lug comprises a set screw threadably associated with the tubular shell, and wherein the set screw is movable into engagement with the recess in order to maintain the tubular mandrel and the tubular shell at the desired relative position.

40. The tubing hanger as claimed in claim 38, wherein the first mandrel connector is a threaded connector so that the first connection is a first threaded connection, wherein the second connection is a second threaded connection, and wherein the first threaded connection and the second threaded connection are threaded in opposite directions.

41. The tubing hanger as claimed in claim 38, wherein each of the tongs in the pair of tongs has a tong length, wherein the tong gripping surface has a gripping surface length, and wherein the gripping surface length is greater than the tong length.

42. The tubing hanger as claimed in claim 38, further comprising a shell seal device associated with the external shell surface, for providing a seal between the tubular shell and the tubing head.

43. The tubing hanger as claimed in claim 42, further comprising a mandrel seal device associated with at least one of the external mandrel surface and the shell bore, for providing a seal between the tubular mandrel and the tubular shell.

44. The tubing hanger as claimed in claim 38, wherein the first mandrel connector comprises a threaded connector.

45. The tubing hanger as claimed in claim 44, wherein the first mandrel connector comprises an external upset end (EUE) pin connector.

46. The tubing hanger as claimed claim 44, wherein the second connection comprises a second threaded connection.

47. The tubing hanger as claimed in claim 46, wherein the second mandrel connector comprises a pin connector defined by the external mandrel surface and wherein the shell connector comprises a box connector defined by the shell bore.

48. The tubing hanger as claimed in claim 38, wherein the tubular mandrel is further comprised of a third mandrel connector located at the second mandrel end which is adapted for connecting the tubular mandrel with a lifting member in order to provide a third connection between the tubular mandrel and the lifting member.

49. The tubing hanger as claimed in claim 48, wherein the third mandrel connector comprises a threaded connector.

50. The tubing hanger as claimed in claim 49, wherein the third mandrel connector comprises an external upset end (EUE) box connector.

51. The tubing hanger as claimed in claim 38, wherein the maximum clearance diameter is 6 inches and the maximum mandrel diameter is less than 6 inches.

52. The tubing hanger as claimed in claim 51, wherein the maximum clearance diameter is 5 inches and the maximum mandrel diameter is less than 5 inches.

53. The tubing hanger as claimed in claim 38, wherein the gripping span is 11 inches.

54. The tubing hanger as claimed in claim 38, in which the tong gripping surface has a gripping surface length, and the gripping surface length is more than 4 inches and no greater than 15 inches.

55. The tubing hanger as claimed in claim 54, in which the gripping surface length is 6 inches.

56. The tubing hanger as claimed in claim 38, wherein the tong gripping surface has a first gripping surface end and a second gripping surface end, wherein the first gripping surface end is between the first mandrel end and the second gripping surface end, wherein the tubular mandrel has a first span length between the first gripping surface end and the first mandrel end, and wherein the first span length is no greater than 8 inches.

57. A method of connecting or disconnecting a tubing hanger to or from a well tubing using a power tong device having a pair of tongs, a gripping span between the upper and lower tongs and a maximum clearance distance for an object passing vertically through the tongs, the method comprising the steps of:

providing a tubing hanger having a tubular mandrel, a recess associated with the tubular mandrel, and a tubular shell, the tubular mandrel having a first connection end, a second connection end, a mandrel bore and an external mandrel surface, the external mandrel surface defining a tong gripping surface having a gripping surface length, the tong gripping surface being located between said first and second connection ends;

connecting the tubular shell to the second connection end of the tubular mandrel, a lug being associated with the tubular shell;

moving the lug into engagement with the recess with the tubular shell connected to the tubular mandrel;

providing well tubing adjacent to said tubing hanger;

gripping said tubing hanger on said gripping surface with one tong of said pair of tongs while gripping said well tubing with the other tong of said pair of tongs whereby the first connection end is located within said gripping span; and actuating said tongs to rotate said tubing hanger and well tubing relative to one another to connect or disconnect said tubing hanger and well tubing.

58. The method as claimed in claim 57, wherein said well tubing comprises a box connector and said step of gripping said well tubing with the other tong of said pair of tongs comprises gripping said box connector with the other of said pair of tongs.

59. The method as claimed in claim 57, further including the step of positioning one of said tongs on said gripping surface clear of any threaded portion of said connection ends.

60. The method as claimed in claim 57, wherein the tong gripping surface has a first gripping surface end and a second gripping surface end further including the step of gripping said tong gripping surface at said first gripping surface end with said first connection end located in said gripping span.

61. The method as claimed in claim 57, wherein said tubular shell has a first shell end, a second shell end, a shell bore comprising a shell connector adapted to engage the second connection end to provide a connection between said tubular mandrel and said tubular shell, and an external shell surface defining a tubing head engagement surface adapted to engage a tubing head to be supported thereby.

62. The method as claimed in claim 57, wherein the lug comprises a set screw threadably associated with the tubular shell.

63. A two part tubing hanger adapted to be connected to and disconnected from a well tubing using a power tong device having a pair of tongs, a gripping span between the pair of tongs, and a maximum clearance diameter for an object passing through the tongs, the tubing hanger comprising:

a first part comprising a tubular mandrel defining a first mandrel end, a second mandrel end, an external mandrel surface between the first and second mandrel ends, a maximum mandrel diameter less than said maximum clearance diameter, and a mandrel bore, the tubular mandrel comprising:

a first mandrel connector located at the first mandrel end;

a second mandrel connector located between the first mandrel end and the second mandrel end, the first mandrel connector being adapted to engage a matching connector on a well tubing to provide a connection between the tubular mandrel and the well tubing; and a tong gripping surface, defined by the external mandrel surface, that is clear of external and internal threading;

wherein the tubular mandrel is configured to permit the power tong device to grip the tong gripping surface and the well tubing within the gripping span and provide the connection between the tubular mandrel and the well tubing;

a second part comprising a tubular shell having a first shell end, a second shell end, a shell bore comprising a shell connector adapted to engage the second mandrel connector to provide a connection between the tubular mandrel and the tubular shell, and an external shell surface defining a tubing head engagement surface adapted to engage a tubing head to be supported thereby; and a recess positioned in the tubular mandrel and a movable lug positioned in, and movable relative to, the tubular shell, wherein the lug is movable into engagement with the recess when the tubular mandrel and the tubular shell are connected with each other at a desired relative position in order to maintain the tubular mandrel and the tubular shell at the desired relative position, wherein when the tubular mandrel is connected to the tubular shell the tong gripping surface extends from the first shell end toward the first mandrel end.

64. The two part tubing hanger as claimed in claim 63, wherein said tong gripping surface has a tong gripping length which is greater than 4 inches and no greater than 15 inches.

65. A method of supporting a tubing string comprised of one or more lengths of well tubing within a well bore at a tubing head, said method comprising the steps of:

providing a tubular mandrel having a first connection end, a second connection end, a mandrel bore, a recess, and an external mandrel surface, the external mandrel surface defining a tong gripping surface, the tong gripping surface being located between said first and second connection ends;

providing a well tubing adjacent to said first connection end of said tubular mandrel;

gripping said tubular mandrel on said tong gripping surface with one of a pair of tongs of a power tong device while gripping said well tubing with the other of said pair of tongs, said pair of tongs defining a gripping span therebetween, whereby the first connection end is located within said gripping span;

actuating said power tong device to rotate said tubular mandrel and said well tubing relative to one another to connect said tubular mandrel and said well tubing;

releasing said pair of tongs from said tubular mandrel and said well tubing;

providing a tubular shell having (a) a first shell end, (b) a second shell end, (c) a shell bore extending through said tubular shell between said first shell end and said second shell end, said shell bore being sized and shaped to receive said second connection end of said tubular mandrel within said bore, said bore comprising a shell connector adapted to engage the second connection end to provide a connection between said tubular mandrel and said tubular shell, (d) an external shell surface defining a tubing head engagement surface adapted to engage said tubing head and (e) a lug associated therewith;

connecting said tubular shell to said tubular mandrel;

moving said lug into engagement with said recess with said tubular shell connected to said tubular mandrel; and allowing a weight of said well tubing to draw said tubing head engagement surface of said tubular shell into engagement with said tubing head to be supported thereby.

66. A two part tubing hanger adapted to support a tubing string comprised of one or more lengths of well tubing within a well bore at a tubing head, the two part tubing hanger comprising:

a first part comprising a tubular mandrel defining a first mandrel end, a second mandrel end, an external mandrel surface between the first and second mandrel ends, a maximum mandrel diameter less than a maximum clearance diameter, and a mandrel bore, the tubular mandrel comprising:

a first mandrel connector located at the first mandrel end; and a second mandrel connector located between the first mandrel end and the second mandrel end, the first mandrel connector being adapted to engage a matching connector on a well tubing to provide a connection between the tubular mandrel and the well tubing;

a second part comprising a tubular shell having (a) a first shell end, (b) a second shell end, (c) a shell bore extending through said tubular shell between said first shell end and said second shell end, said shell bore defining a shell connector adapted to receive said second mandrel connector of said tubular mandrel within said bore and engage said second mandrel connector to provide a connection between the tubular mandrel and the tubular shell, and (d) an external shell surface defining a tubing head engagement surface adapted to engage a tubing head to be supported thereby; and a recess associated with the tubular mandrel and a lug associated with the tubular shell, wherein the lug is movable into engagement with the recess when the tubular mandrel and the tubular shell are connected with each other at a desired relative position in order to maintain the tubular mandrel and the tubular shell at the desired relative position.

67. The two part tubing hanger as claimed in claim 66, wherein the lug comprises a set screw threadably associated with the tubular shell, and wherein the set screw is movable into engagement with the recess in order to maintain the tubular mandrel and the tubular shell at the desired relative position.

68. The two part tubing hanger as claimed in claim 66, further comprising a tong gripping surface, defined by the external mandrel surface, that is clear of external and internal threading;

wherein the tubular mandrel is configured to permit a power tong device of the type having a pair of tongs, to grip the tong gripping surface and the well tubing within a gripping span between the pair of tongs, and provide the connection between the tubular mandrel and the well tubing; and wherein when the tubular mandrel is connected to the tubular shell the tong gripping surface extends from the first shell end toward the first mandrel end.

69. A method of using said two part tubing hanger defined in claim 66 to access an annulus between said tubular mandrel and said tubing string, and a wall of the well bore when the two part tubing hanger is connected to said tubing string and supported by said tubing head, said method comprising the steps of:

lifting said two part tubing hanger from said tubing head a sufficient height to expose said lug;

moving said lug out of engagement with said recess;

disconnecting said tubular shell from said tubular mandrel; and lifting said disconnected tubular shell from said tubing head to allow access to said annulus.

70. A method of using said two part tubing hanger defined in claim 66, to release a tubing string stuck in a well bore when the two part tubing hanger is connected to said tubing string and supported by said tubing head, said method comprising the steps of:

lifting said two part tubing hanger from said tubing head a sufficient height to expose said lug;

moving said lug out of engagement with said recess;

disconnecting said tubular shell from said tubular mandrel; and reciprocating said tubular mandrel and said tubing string within said well bore to release said tubing string.

71. The method as claimed in claim 70, further comprising the step of mounting a blowout preventer to said tubing head before said reciprocating step.

* * * * *